US009506416B2

(12) United States Patent
Suzuki et al.

(10) Patent No.: US 9,506,416 B2
(45) Date of Patent: Nov. 29, 2016

(54) INTER-CYLINDER AIR-FUEL RATIO VARIATION ABNORMALITY DETECTION APPARATUS FOR MULTICYLINDER INTERNAL COMBUSTION ENGINE

(71) Applicants: Kenji Suzuki, Susono (JP); Hiroshi Miyamoto, Susono (JP); Yasushi Iwazaki, Ebina (JP)

(72) Inventors: Kenji Suzuki, Susono (JP); Hiroshi Miyamoto, Susono (JP); Yasushi Iwazaki, Ebina (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 462 days.

(21) Appl. No.: 14/095,567

(22) Filed: Dec. 3, 2013

(65) Prior Publication Data

US 2014/0156205 A1 Jun. 5, 2014

(30) Foreign Application Priority Data

Dec. 4, 2012 (JP) ..... 2012-265675

(51) Int. Cl.
*F02D 41/00* (2006.01)
*F02D 41/14* (2006.01)

(52) U.S. Cl.
CPC ..... *F02D 41/1495* (2013.01); *F02D 41/0085* (2013.01); *F02D 41/1456* (2013.01)

(58) Field of Classification Search
CPC ..... F02D 41/0085
USPC ..... 702/24
See application file for complete search history.

(56) References Cited

U.S. PATENT DOCUMENTS

2011/0054761 A1 3/2011 Sawada et al.
2011/0308506 A1* 12/2011 Hayashita ..... F02D 41/0085 123/703
2012/0116644 A1* 5/2012 Anzawa ..... G01M 15/104 701/99
2012/0209498 A1 8/2012 Aoki et al.
2012/0283931 A1* 11/2012 Otsuka ..... B60W 30/1882 701/103

FOREIGN PATENT DOCUMENTS

JP 2006-009674 A 1/2006
JP 2011-047332 A 3/2011
WO 2011042994 A1 4/2011

* cited by examiner

*Primary Examiner* — Bryan Bui
(74) *Attorney, Agent, or Firm* — Dinsmore & Shohl LLP

(57) ABSTRACT

A first parameter correlated with a degree of a variation in the output from the air-fuel ratio sensor is calculated. A possible range of a second parameter representing a degree of a variation in air-fuel ratio among the cylinders is determined based on the first parameter. The first parameter is calculated with an air-fuel ratio of a predetermined cylinder forcibly changed. A difference between the unchanged first parameter and the forcibly changed first parameter is determined. A first characteristic representing a relation between the second parameter and the difference is determined based on the possible range of the second parameter and the difference. One of the determination value and the first parameter calculated before the forced change is corrected based on inclination of the determined first characteristic.

7 Claims, 19 Drawing Sheets

NO IMBALANCE IN NORMAL STATE (A) BEFORE FORCIBLE INTRODUCTION OF IMBALANCE

| CYLINDER | #1 | #2 | #3 | #4 |
|---|---|---|---|---|
| AIR | 14.5 | 14.5 | 14.5 | 14.5 |
| FUEL | 1 | 1 | 1 | 1 |
| A/F | 14.5 | 14.5 | 14.5 | 14.5 |

IMBALANCE RATE
14.5/14.5 = 1.00 = 0%

(B) AFTER FORCIBLE INTRODUCTION OF IMBALANCE

| CYLINDER | #1 | #2 | #3 | #4 |
|---|---|---|---|---|
| AIR | 14.5 | 14.5 | 14.5 | 14.5 |
| FUEL | 1.15 | 0.95 | 0.95 | 0.95 |
| A/F | 12.61 | 15.26 | 15.26 | 15.26 |

IMBALANCE RATE
15.26/12.61 = 1.2105 = 21.05%

IMBALANCE PRESET IN NORMAL STATE (C) BEFORE FORCIBLE INTRODUCTION OF IMBALANCE

| CYLINDER | #1 | #2 | #3 | #4 |
|---|---|---|---|---|
| AIR | 13 | 15 | 15 | 15 |
| FUEL | 1 | 1 | 1 | 1 |
| A/F | 13 | 15 | 15 | 15 |

IMBALANCE RATE
15/13 = 1.1538 = 15.38%

(D) AFTER FORCIBLE INTRODUCTION OF IMBALANCE

| CYLINDER | #1 | #2 | #3 | #4 |
|---|---|---|---|---|
| AIR | 13 | 15 | 15 | 15 |
| FUEL | 1.15 | 0.95 | 0.95 | 0.95 |
| A/F | 11.30 | 15.79 | 15.79 | 15.79 |

IMBALANCE RATE
15.79/11.30 = 1.3967 = 39.67%

FIG.5

INTER-CYLINDER AIR-FUEL RATIO VARIATION ABNORMALITY DETECTION APPARATUS FOR MULTICYLINDER INTERNAL COMBUSTION ENGINE

CROSS-REFERENCES TO RELATED APPLICATIONS

This application claims the benefit of Japanese Patent Application No. 2012-265675, filed Dec. 4, 2012, which is hereby incorporated by reference herein in its entirety.

BACKGROUND OF THE INVENTION

Field of the Invention

The present invention relates to an apparatus for detecting variation abnormality in air-fuel ratio among cylinders of a multicylinder internal combustion engine, and in particular, to an apparatus that detects abnormality (imbalance abnormality) in which the air-fuel ratio of one cylinder deviates relatively significantly from the air-fuel ratio of the remaining cylinders.

Description of the Related Art

In general, an internal combustion engine with an exhaust purification system utilizing a catalyst efficiently removes harmful exhaust components using the catalyst and thus needs to control the mixing ratio between air and fuel in an air-fuel mixture combusted in the internal combustion engine, that is, the air-fuel ratio. To control the air-fuel ratio, an air-fuel ratio sensor is provided in an exhaust passage in the internal combustion engine to perform feedback control to make the detected air-fuel ratio equal to a predetermined target air-fuel ratio.

On the other hand, a multicylinder internal combustion engine normally controls the air-fuel ratio using identical controlled variables for all cylinders. Thus, even when the air-fuel ratio control is performed, the actual air-fuel ratio may vary among the cylinders. In this case, if the variation is at a low level, the variation can be absorbed by the air-fuel ratio feedback control, and the catalyst also serves to remove harmful exhaust components. Consequently, such a low-level variation does not affect exhaust emissions and pose an obvious problem.

However, if the air-fuel ratio among the cylinders significantly vary since, for example, fuel injection systems for apart of cylinders become defective, the exhaust emissions disadvantageously deteriorate. Such a significant variation in air-fuel ratio as deteriorates the exhaust emissions is desirably detected as abnormality. In particular, for automotive internal combustion engines, there has been a demand to detect variation abnormality in air-fuel ratio among the cylinders in a vehicle mounted state (on board) in order to prevent a vehicle with deteriorated exhaust emissions from travelling.

A possible method for detecting variation abnormality in air-fuel ratio among the cylinders involves calculating a parameter correlated with the degree of variation in output from the air-fuel ratio sensor and comparing the calculated parameter with a predetermined determination value to detect abnormality.

When the output from the air-fuel ratio sensor is utilized, the output characteristic (gain, responsiveness, or the like) of the actually installed air-fuel ratio sensor is advantageously taken into account for improving detection accuracy. Thus, according to PTL1: Japanese Patent Laid-Open No. 2011-47332, it is determined whether or not the output characteristic of the air-fuel ratio is appropriate, and when the output characteristic is determined not to be appropriate, imbalance determination, that is, variation abnormality detection, is inhibited.

When the output characteristic of the actually installed air-fuel ratio sensor is taken into account, an air-fuel ratio varying state may forcibly be generated, and the resulting output from the air-fuel ratio may be utilized.

However, the results of the present inventors' studies indicate that it is insufficient to simply utilize the output from the air-fuel ratio sensor resulting from the forcible generation of the air-fuel ratio varying state. That is, accurate detection of variation abnormality has been found to be difficult to achieve unless an output from the air-fuel ratio sensor obtained before the forcible generation of the air-fuel ratio varying state is also utilized.

Thus, in view of these circumstances, it is an object of the present invention to provide an inter-cylinder air-fuel ratio variation abnormality detection apparatus which also utilizes the output from the air-fuel ratio sensor obtained before the forcible generation of the air-fuel ratio varying state to enable the accuracy of detection of variation abnormality to be improved.

SUMMARY OF THE INVENTION

An aspect of the present invention provides an inter-cylinder air-fuel ratio variation abnormality detection apparatus for a multicylinder internal combustion engine, the apparatus being configured to calculate a first parameter correlated with a degree of a variation in output from an air-fuel ratio sensor installed in an exhaust passage common to a plurality of cylinders and comparing the calculated first parameter with a predetermined determination value to detect variation abnormality in air-fuel ratio among cylinders, the apparatus being configured to carry out:

(A) a step of calculating the first parameter;

(B) a step of determining a possible range of a second parameter representing a degree of a variation in air-fuel ratio among the cylinders based on the calculated first parameter;

(C) a step of calculating the first parameter with an air-fuel ratio of a predetermined cylinder forcibly changed;

(D) a step of calculating a difference between the unchanged first parameter and the forcibly changed first parameter;

(E) a step of determining a first characteristic representing a relation between the second parameter and the difference based on the possible range of the second parameter and the difference; and (F) a step of correcting one of the determination value and the first parameter calculated in the step (A) based on inclination of the determined first characteristic.

Preferably, in the step (E), the first characteristics preset for a tolerance upper limit product and a tolerance lower limit product of the air-fuel ratio sensor are utilized to determine the first characteristic passing through an intersection point between the difference calculated in the step (D) and a predetermined value within the possible range of the second parameter by interpolating the first characteristics of the tolerance upper limit product and the tolerance lower limit product, and the resulting first characteristic is determined to be first characteristic to be determined.

Preferably, the predetermined value within the possible range of the second parameter is such a value within the possible range of the second parameter as minimizes the degree of a variation.

Preferably, the first characteristics preset for the tolerance upper limit product and the tolerance lower limit product of the air-fuel ratio sensor are such characteristics as increases the difference as the second parameter varies toward higher degrees of variation.

Preferably, the inclination of the first characteristic preset for the tolerance upper limit product is larger than the inclination of the first characteristic preset for the tolerance lower limit product.

Preferably, in the step (B), the inter-cylinder air-fuel ratio variation abnormality detection apparatus utilizes second characteristics which are preset for the tolerance upper limit product and the tolerance lower limit product of the air-fuel ratio sensor and which represent relations between the first parameter and the second parameter, to determine the a possible range of the second parameter to be a range of the second parameter between intersection points between the first parameter calculated in the step (A) and each of the second characteristics of the tolerance upper limit product and the tolerance lower limit product.

Preferably, the steps (A) and (C) include a step of normalizing the first parameter according to an operating status of the internal combustion engine.

The present invention exerts an excellent effect that also utilizes an output from an air-fuel ratio sensor obtained before forcible generation of a air-fuel ratio varying state to enable the accuracy of detection of variation abnormality to be improved.

Further features of the present invention will become apparent from the following description of exemplary embodiments (with reference to the attached drawings).

BRIEF DESCRIPTION OF THE DRAWINGS

FIG. 5 is tables for comparison of an imbalance rate among various cases;

DESCRIPTION OF THE EMBODIMENTS

An embodiment of the present invention will be described below with reference to the attached drawings.

Figure 1:
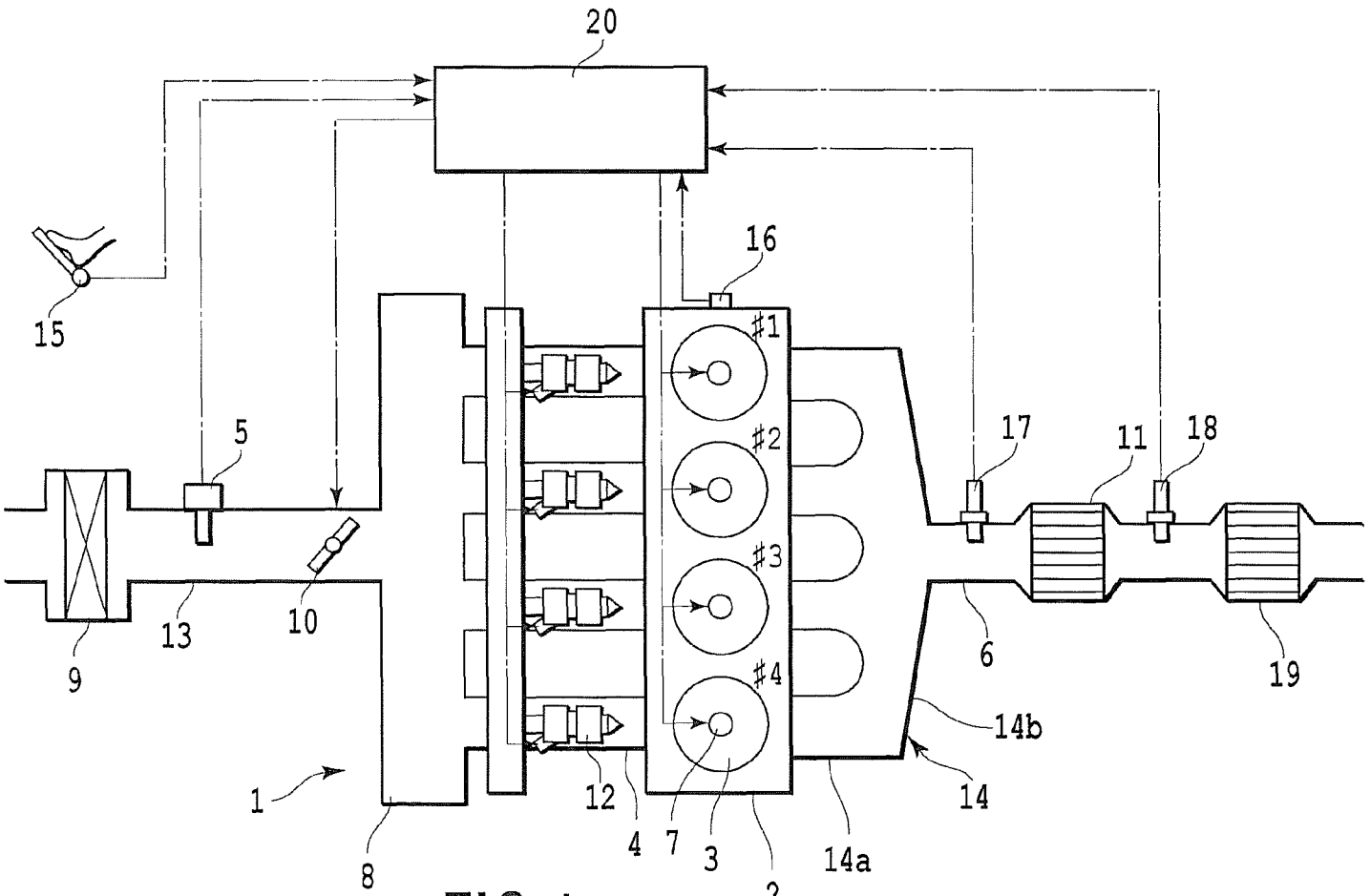
FIG. 1 is a schematic diagram of an internal combustion engine according to an embodiment of the present invention.

FIG. 1 is a schematic diagram of an internal combustion engine according to the present embodiment. An internal combustion engine (engine) 1 combusts a mixture of fuel and air inside a combustion chamber 3 formed in a cylinder block 2, and reciprocates a piston in the combustion chamber 3 to generate power. The internal combustion engine 1 according to the present embodiment is a multicylinder internal combustion engine mounted in a car, more specifically, an inline-four spark ignition internal combustion engine. The internal combustion engine 1 includes a #1 cylinder to a #4 cylinder. However, the number, type, and the like of cylinders are not particularly limited.

Although not shown in the drawings, each cylinder includes an intake valve disposed therein to open and close an intake port and an exhaust valve disposed therein to open and close an exhaust port. Each intake valve and each exhaust valve are opened and closed by a cam shaft. Each cylinder includes an ignition plug 7 attached to a top portion of a cylinder head to ignite the air-fuel mixture in the combustion chamber 3.

The intake port of each cylinder is connected, via a branch pipe 4 for the cylinder, to a surge tank 8 that is an intake air aggregation chamber. An intake pipe 13 is connected to an upstream side of the surge tank 8, and an air cleaner 9 is provided at an upstream end of the intake pipe 13. The intake pipe 13 incorporates an air flow meter 5 (intake air amount detection device) for detecting the amount of intake air and an electronically controlled throttle valve 10, the air flow meter 5 and the throttle valve 10 being arranged in order from the upstream side. The intake port, the branch pipe 4, the surge tank 8, and the intake pipe 13 form an intake passage.

Each cylinder includes an injector (fuel injection valve) 12 disposed therein to inject fuel into the intake passage, particularly the intake port. The fuel injected by the injector 12 is mixed with intake air to form an air-fuel mixture, which is then sucked into the combustion chamber 3 when the intake valve is opened. The air-fuel mixture is compressed by the piston and then ignited and combusted by the ignition plug 7. The injector may inject fuel directly into the combustion chamber 3.

On the other hand, the exhaust port of each cylinder is connected to an exhaust manifold 14. The exhaust manifold 14 includes a branch pipe 14*a* for each cylinder which forms an upstream portion of the exhaust manifold 14 and an exhaust aggregation section 14*b* forming a downstream portion of the exhaust manifold 14. An exhaust pipe 6 is connected to the downstream side of the exhaust aggregation section 14*b*. The exhaust port, the exhaust manifold 14, and the exhaust pipe 6 form an exhaust passage.

Furthermore, the exhaust passage located downstream of the exhaust aggregation section 14*b* of the exhaust manifolds 14 forms an exhaust passage common to the #1 to #4 cylinders that are the plurality of cylinders.

Catalysts each including a three-way catalyst, that is, an upstream catalyst 11 and a downstream catalyst 19, are arranged in series and attached to an upstream side and a downstream side, respectively, of the exhaust pipe 6. The catalysts 11 and 19 have an oxygen storage capacity ($O_2$ storage capability). That is, the catalysts 11 and 19 store excess air in exhaust gas to reduce NOx when the air-fuel ratio of exhaust gas is higher (leaner) than a stoichiometric ratio (theoretical air-fuel ratio, for example, A/F=14.6). Furthermore, the catalysts 11 and 19 emit stored oxygen to oxidize HO and CO in the exhaust gas when the air-fuel ratio of exhaust gas is lower (richer) than the stoichiometric ratio.

A first air-fuel ratio sensor and a second air-fuel ratio sensor, that is, a pre-catalyst sensor 17 and a post-catalyst sensor 18, are installed upstream and downstream, respectively, of the upstream catalyst 11 to detect the air-fuel ratio of exhaust gas. The pre-catalyst sensor 17 and the post-catalyst sensor 18 are installed immediately before and after the upstream catalyst, respectively, to detect the air-fuel ratio based on the concentration of oxygen in the exhaust. The single pre-catalyst sensor 17 is thus installed in an exhaust junction section located upstream of the upstream catalyst 11. In the present embodiment, the pre-catalyst sensor 17 corresponds to an "air-fuel ratio sensor" according to the present invention.

The ignition plug 7, the throttle valve 10, the injector 12, and the like are electrically connected to an electronic control unit (hereinafter referred to as an ECU) 20 serving as a control device or a control unit. The ECU 20 includes a CPU, a ROM, a RAM, an I/O port, and a storage device, none of which is shown in the drawings. Furthermore, the ECU connects electrically to, besides the above-described airflow meter 5, pre-catalyst sensor 17, and post-catalyst sensor 18, a crank angle sensor 16 that detects the crank angle of the internal combustion engine 1, an accelerator opening sensor 15 that detects the opening of an accelerator, and various other sensors via A/D converters or the like (not shown in the drawings). Based on detection values from the various sensors, the ECU 20 controls the ignition plug 7, the throttle valve 10, the injector 12, and the like to control an ignition period, the amount of injected fuel, a fuel injection period, a throttle opening, and the like in accordance with various program stored in the ROM so as to obtain desired outputs.

The throttle valve 10 includes a throttle opening sensor (not shown in the drawings), which transmits a signal to the ECU 20. The ECU 20 feedback-controls the opening of the throttle valve 10 (throttle opening) to a target throttle opening dictated according to the accelerator opening.

Based on a signal from the air flow meter 5, the ECU 20 detects the amount of intake air, that is, an intake flow rate, which is the amount of air sucked per unit time. The ECU 20 detects a load on the engine 1 based on one of the detected throttle opening and amount of intake air.

Based on a crank pulse signal from the crank angle sensor 16, the ECU 20 detects the crank angle itself and the number of rotations of the engine 1. Here, the "number of rotations" refers to the number of rotations per unit time and is used synonymously with rotation speed. According to the present embodiment, the number of rotations refers to the number of rotations per minute rpm.

Figure 2:
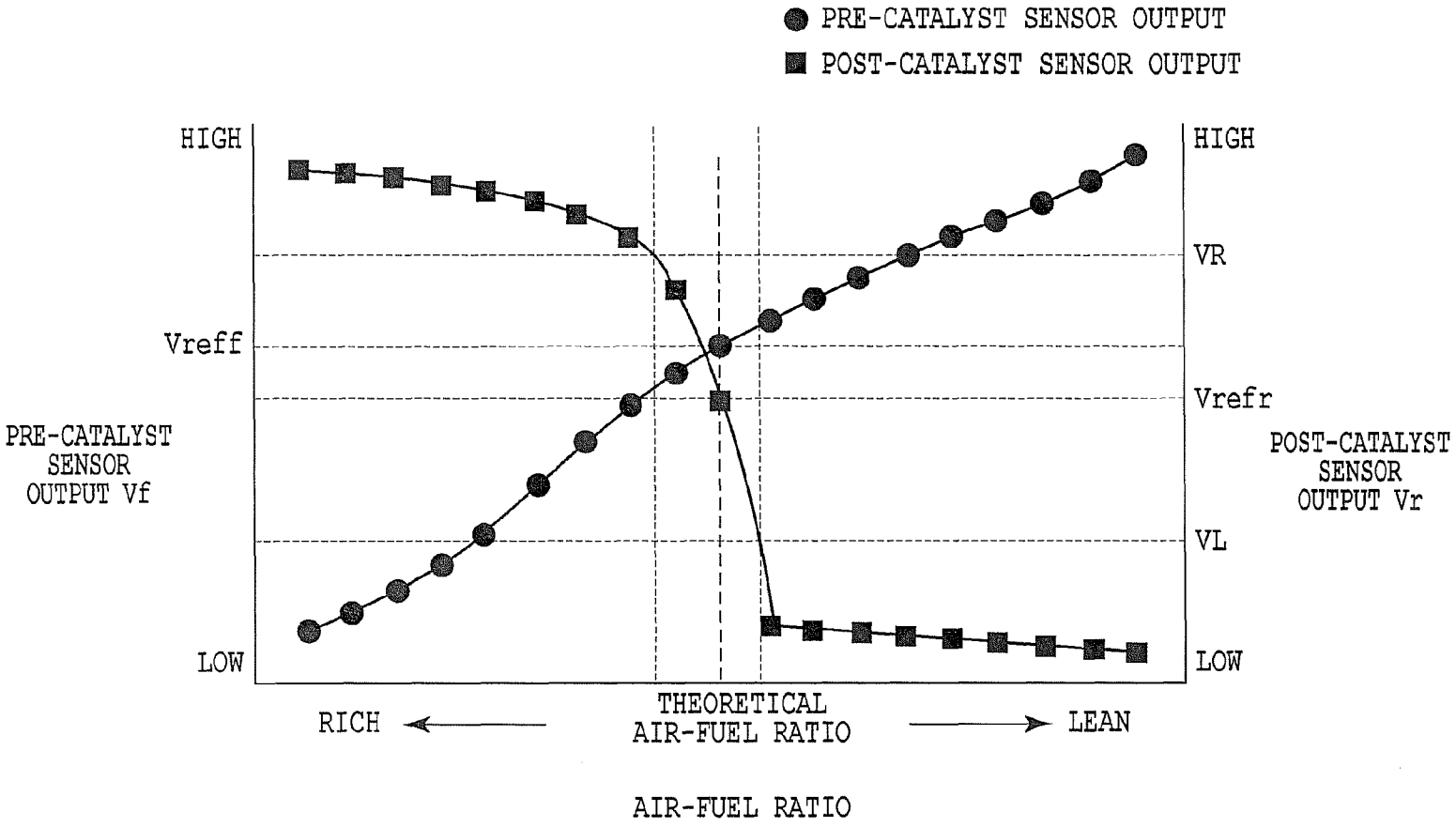
FIG. 2 is a graph showing the output characteristics of a pre-catalyst sensor and a post-catalyst sensor.

The pre-catalyst sensor 17 includes what is called a wide-range air-fuel ratio sensor and can consecutively detect a relatively wide range of air-fuel ratios. FIG. 2 shows output characteristic of the pre-catalyst sensor 17. As shown in FIG. 2, the pre-catalyst sensor 17 outputs a voltage signal Vf of a magnitude proportional to an exhaust air-fuel ratio. An output voltage obtained when the exhaust air-fuel ratio is stoichiometric is Vreff (for example, 3.3 V).

On the other hand, the post-catalyst sensor 18 includes what is called an $O_2$ sensor and is characterized by an output value changing rapidly beyond the stoichiometric ratio. FIG. 2 shows the output characteristic of the post-catalyst sensor. As shown in FIG. 2, an output voltage obtained when the exhaust air-fuel ratio is stoichiometric, that is, a stoichiometrically equivalent value is Vrefr (for example, 0.45 V). The output voltage of the post-catalyst sensor 21 varies within a predetermined range (for example, from 0 V to 1 V). When the exhaust air-fuel ratio is leaner than the stoichiometric ratio, the output voltage of the post-catalyst sensor is lower than the stoichiometrically equivalent value Vrefr. When the exhaust air-fuel ratio is richer than the stoichiometric ratio, the output voltage of the post-catalyst sensor is higher than the stoichiometrically equivalent value Vrefr.

The upstream catalyst 11 and the downstream catalyst 19 simultaneously remove NOx, HC, and CO, which are harmful components in the exhaust, when the air-fuel ratio of exhaust gas flowing into each of the catalysts is close to the stoichiometric ratio. The range (window) of the air-fuel ratio within which the three components can be efficiently removed at the same time is relatively narrow.

Thus, during normal operation, the ECU 20 performs air-fuel ratio feedback control so as to control the air-fuel ratio of exhaust gas flowing into the upstream catalyst 11 to the neighborhood of the stoichiometric ratio. The air-fuel ratio feedback control includes main air-fuel ratio control that may make the exhaust air-fuel ratio detected by the pre-catalyst sensor 17 equal to the stoichiometric ratio, a predetermined target air-fuel ratio (main air-fuel ratio feedback control) and sub air-fuel ratio control that may make the exhaust air-fuel ratio detected by the post-catalyst sensor 18 equal to the stoichiometric ratio (sub air-fuel ratio feedback control).

The air-fuel ratio feedback control using the stoichiometric ratio as the target air-fuel ratio is referred to as stoichiometric control. The stoichiometric ratio corresponds to a reference air-fuel ratio.

For example, some of all the cylinders, particularly one cylinder, may fail to cause a variation (imbalance) in the air-fuel ratio among the cylinders. For example, the injector 12 for the #1 cylinder may fail, and a larger amount of fuel may be injected by the #1 cylinder than by the other cylinders, the #2, #3, and #4 cylinders. Thus, the air-fuel ratio in the #1 cylinder may be shifted significantly toward a rich side. Even in this case, the air-fuel ratio of total gas supplied to the pre-catalyst sensor 17 may be controlled to the stoichiometric ratio by performing the above-described stoichiometric control to apply a relatively large amount of correction. However, the air-fuel ratios of the individual cylinders are such that the air-fuel ratio of the #1 cylinder is much richer than the stoichiometric ratio, whereas and the air-fuel ratio of the #2, #3, and #4 cylinders is slightly leaner than the stoichiometric ratio. Thus, the air-fuel ratios are only totally in balance; only the total air-fuel ratio is stoichiometric. This is not preferable for emission control. Thus, the present embodiment includes an apparatus that detects such variation abnormality in air-fuel ratio among the cylinders.

An aspect of variation abnormality detection according to the present embodiment will be described below.

Figure 3:
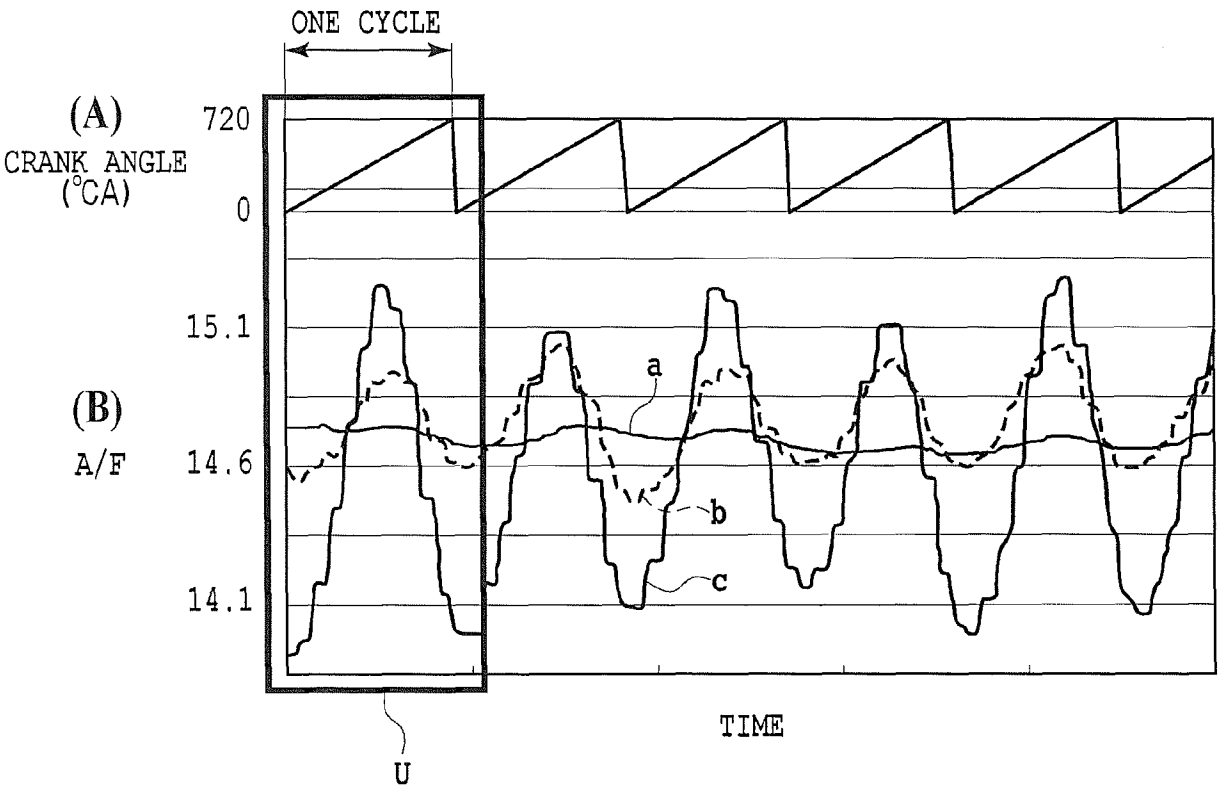
FIG. 3 is a graph showing a variation in exhaust air-fuel ratio according to the degree of a variation in air-fuel ratio among cylinders.

As schematically shown in FIG. 3, the exhaust air-fuel ratio varies periodically at every engine cycle (=720° CA), but varies significantly during each engine cycle when the air-fuel ratio varies among the cylinders. Air-fuel ratio lines a, b, c in (B) show air-fuel ratios detected by the pre-catalyst sensor 17 when no variation occurs in air-fuel ratio, when the air-fuel ratio shifts toward the rich side in only one cylinder at an imbalance rate of +20%, and when the air-fuel ratio shifts toward the rich side in only one cylinder at an imbalance rate of +50%, respectively. As seen in the air-fuel ratio lines, the amplitude of the variation in air-fuel ratio increases consistently with the degree of the variation among the cylinders.

In this case, the imbalance rate is a parameter (second parameter) representing the degree of the variation in air-fuel ratio among the cylinders. That is, the imbalance rate is a value representing the rate at which, if only one of all the cylinders is subjected to an air-fuel ratio shift with respect to the remaining cylinders, the cylinder subjected to the air-fuel ratio shift (imbalanced cylinder) deviates from the cylinders free from the air-fuel ratio shift (balanced cylinders). According to the present embodiment, the imbalance rate B is expressed by a formula below. An increase in imbalance rate B from 1 correspondingly increases the difference in air-fuel ratio between the imbalanced cylinder and the balanced cylinders and thus the degree of a variation in air-fuel ratio among the cylinders.

$$B = \frac{A/Fb}{A/Fib} \tag{1}$$

A/Fb denotes the air-fuel ratio of the balanced cylinder, and A/Fib denotes the air-fuel ratio of the imbalanced cylinder. For convenience, the imbalance rate may be shown in percentage. In this case, the imbalance rate B (%) is expressed by a formula below. An increase in the absolute value of the imbalance rate B (%) correspondingly increases the difference in air-fuel ratio between the imbalanced cylinder and the balanced cylinders and thus the degree of a variation in air-fuel ratio among the cylinders.

$$B(\%) = \left\{\frac{A/Fb}{A/Fib} - 1\right\} \times 100 \tag{1'}$$

As seen in FIG. 3, fluctuation of output from the pre-catalyst sensor 17 increases consistently with the absolute value of the imbalance rate B) (%), that is, the degree of a variation in air-fuel ratio among the cylinders.

Thus, utilizing this characteristic, the present embodiment calculates or detects an output fluctuation parameter X that is a parameter (first parameter) correlated with the degree of fluctuation of the output from the pre-catalyst sensor 17, and detects variation abnormality based on the calculated output fluctuation parameter X.

Figure 4:
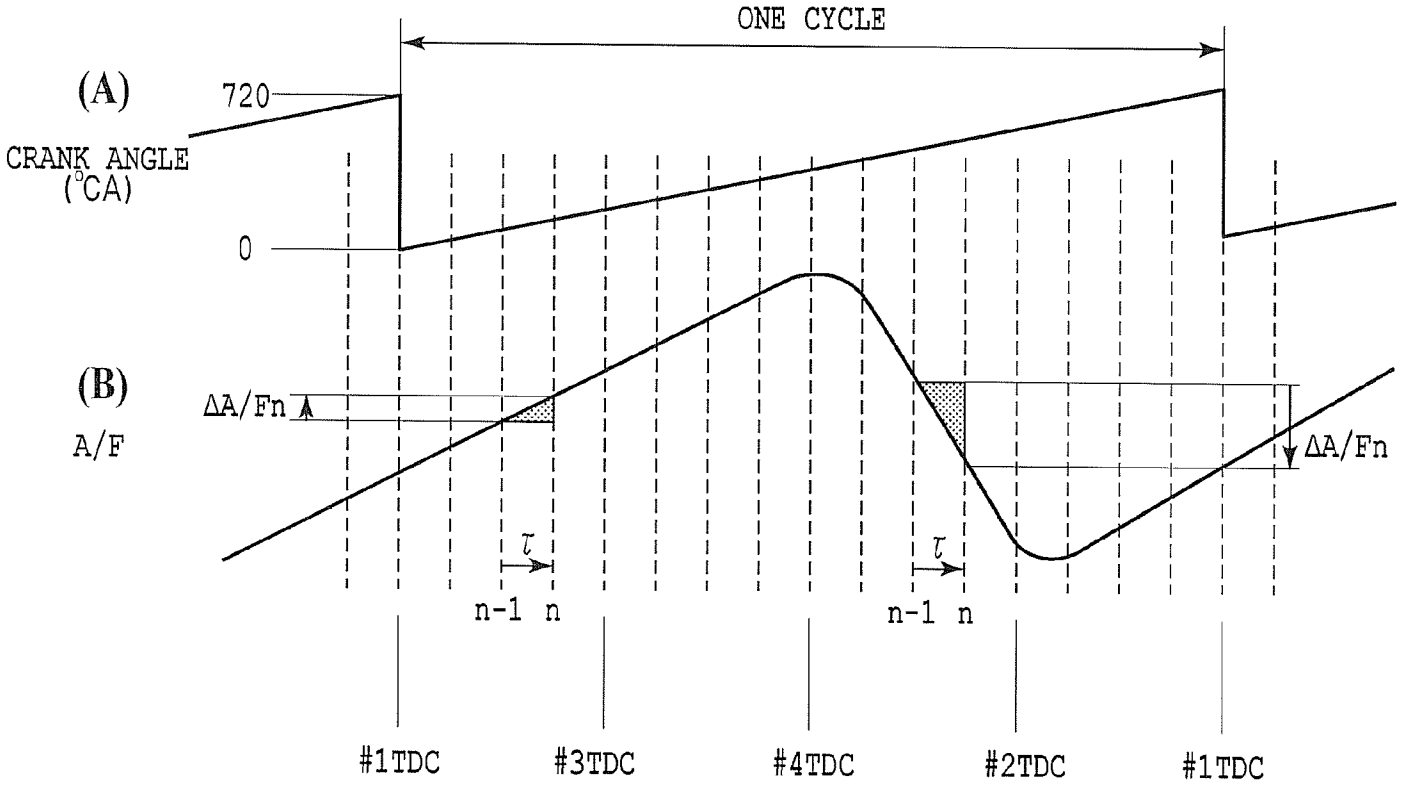
FIG. 4 is an enlarged view corresponding to a U portion in FIG. 3.

A method for calculating the output fluctuation parameter X will be described below. FIG. 4 is an enlarged view corresponding to a U portion in FIG. 3, specifically showing fluctuation of the pre-catalyst sensor output during one engine cycle. The pre-catalyst sensor output is an output voltage Vf from the pre-catalyst sensor 17 converted into the air-fuel ratio A/F. However, the output voltage Vf from the pre-catalyst sensor 17 may be directly used.

As shown in FIG. 4(B), during one engine cycle, the ECU 20 acquires the value of the pre-catalyst sensor output A/F at every predetermined sample period $\tau$. The ECU 20 then uses a formula below to determine the difference (also referred to as an output difference or a sensor output difference) between a value $A/F_n$ acquired at the current (n) timing and a value $A/F_{n-1}$ acquired at the preceding (n−1) timing. The output difference $\Delta A/F_n$ may also be translated as the differential value of the pre-catalyst sensor output at the current timing.

$$\Delta A/F_n = A/F_n - A/F_{n-1} \tag{2}$$

In the simplest aspect, the output difference $\Delta A/F_n$ itself represents the magnitude of fluctuation of the pre-catalyst sensor output. Thus, the output fluctuation parameter may be the absolute value of the output difference $\Delta A/F_n$ at one predetermined timing. However, according to the present embodiment, the output fluctuation parameter is the average value of a plurality of output differences $\Delta A/F_n$ for increased accuracy. The present embodiment calculates the output fluctuation parameter X by averaging the output differences $\Delta A/F_n$ for M engine cycles (for example, M=50). The output fluctuation parameter X increases consistently with the degree of fluctuation of the pre-catalyst sensor output.

However, the output difference $\Delta A/F_n$ may be positive or negative, and thus, the present embodiment distinguishes the positive output difference from the negative output difference for calculations. A method for calculation will be described below in detail. However, the calculation may be carried out without this distinction.

Any value corrected with the degree of fluctuation of the pre-catalyst sensor may be the output fluctuation parameter. For example, the output fluctuation parameter may be calculated based on the difference between the maximum peak and minimum peak (what is called, peak to peak) of the pre-catalyst sensor output during one engine cycle, or the absolute value of the maximum peak or minimum peak of a second order differential value. This is because an increase in the degree of fluctuation of the pre-catalyst sensor output correspondingly increases the difference between the maximum peak and minimum peak of the pre-catalyst sensor output or the absolute value of the maximum peak or minimum peak of a second order differential value.

Then, the calculated output fluctuation parameter X is compared with a predetermined determination value $\alpha$ to determine whether or not variation abnormality is present. For example, variation abnormality is determined to be present when the calculated output fluctuation parameter X is equal to or larger than the determination value $\alpha$ (abnormal) and to be absent when the calculated output fluctuation parameter X is smaller than the determination value $\alpha$ (normal). In general, the determination value $\alpha$ is set in consideration for an OBD (On-Board Diagnosis) regulation value for exhaust emission.

When the pre-catalyst sensor output is utilized to detect variation abnormality as described above, the output characteristic of the actually installed pre-catalyst sensor is advantageously taken into account for increasing detection accuracy. In this case, an air-fuel ratio varying state may be forcibly generated so that the resulting air-fuel ratio sensor output can be utilized.

However, the results of the present inventors' studies indicate that it is insufficient to simply utilize the pre-catalyst sensor output resulting from the forcible generation of the air-fuel ratio varying state and that accurate detection of variation abnormality has been found to be difficult to achieve unless the pre-catalyst sensor output obtained before the forcible generation of the air-fuel ratio varying state, that is, the pre-catalyst sensor output in an normal state, is also utilized. This will be described below.

FIG. 5 is tables for a comparison of the imbalance rate between a case where a variation (imbalance) in air-fuel ratio is present in the normal state and a case where no variation in air-fuel ratio is present in the normal state and a comparison of the imbalance rates obtained before and after the forcible introduction of imbalance. In this case, the normal state has the same meaning as that of the state before the forcible introduction of imbalance. Both states mean a state in which normal control is being performed, that is, a state in which stoichiometric control is being performed. The state after the forcible introduction of imbalance refers to a state in which imbalance is forcibly introduced while the stoichiometric control, which forms a basis, is being performed.

In this case, the values of the amount of fuel and the air-fuel ratio shown in (A) to (D) are obtained after the air-fuel ratio of the total gas has converged at a stoichiometric ratio of 14.5 as a result of the stoichiometric control.

FIG. 5(A) shows a normal state in which no imbalance is present and in which the forcible introduction of imbalance has not been carried out. As seen in FIG. 5(A), all the cylinders are supplied with air the amount of which is equivalent to 14.5 and fuel the amount of which is equivalent to 1, and the air-fuel ratio is stoichiometric equal to 14.5. Hence, the imbalance rate is 14.5/14.5=1.00=0%.

FIG. 5B shows a normal state in which no imbalance is present and in which the forcible introduction of imbalance has been carried out. The amount of air is 14.5 for all the cylinders, and the fuel amount is 1.15 only for the #1 cylinder and 0.95 for the other cylinders. The air-fuel ratio is 12.61 only for the #1 cylinder and 15.26 for the other cylinders. The air-fuel ratio of the #1 cylinder has been forcibly shifted toward the rich side with respect to the air-fuel ratio of the other cylinders. Thus, the imbalance rate is 15.26/12.61=1.2105=21.05%.

The forcible introduction of imbalance or forced imbalance control is carried out to realize the above-described state. That is, when the forcible introduction of imbalance is begun, the amount of fuel injected by only one predetermined cylinder, in this case, the #1 cylinder, is forcibly increased by a predetermined amount. This forcibly shifts the air-fuel ratio of only the #1 cylinder toward the rich side. Subsequently, the stoichiometric control uniformly reduces the amount of injected fuel for all the cylinders in a corrective manner so that the air-fuel ratio of the total gas is stoichiometric. The state finally converges at the illustrated state. In the final state, the difference between the amount fuel in the final state and the fuel amount obtained before the forcible introduction of imbalance is +0.15 for the #1 cylinder and −0.05 for all the other cylinders (=−0.15/3). The average value of the amount of fuel in the respective cylinders is 1, and the air-fuel ratio of the total gas is stoichiometric.

In this case, the imbalance rate resulting from the forcible introduction of imbalance in the normal state with no imbalance has increased by 21.05% from the imbalance rate obtained before the forcible introduction of imbalance. Thus, the forced imbalance is equivalent to an imbalance rate of =21.05% (Bf=1.2105). Bf denotes a forced imbalance amount.

FIG. 5(C) shows a normal state in which imbalance is present and in which the forcible introduction of imbalance has not been carried out. As seen in FIG. 5(C), the fuel amount is 1 for all the cylinders, but the amount of air varies among the cylinders; the amount of air is equivalent to 13 for only the #1 cylinder and 15 for the other cylinders. Hence, the air-fuel ratio is also 13 only for the #1 cylinder and 15 for the other cylinders. Thus, the imbalance rate is 15/13=1.1538=15.38%. The stoichiometric control has resulted in the stoichiometric air-fuel ratio of the total gas.

As described above, only the #1 cylinder has a air-fuel ratio higher than the stoichiometric air-fuel ratio (by 0.15) and is thus rich. The other cylinders have an air-fuel ratio slightly leaner than the stoichiometric air-fuel ratio (by 0.5). This state may result from deviation (insufficiency) of the amount of air in the #1 cylinder. For example, the state may result from blockage of the per-cylinder intake passage (branch pipe 4 and intake port) for the #1 cylinder due to deposit or the like or from inappropriate opening of the intake valve.

FIG. 5(D) shows that imbalance of the forced imbalance amount Bf has been forcibly introduced in the above-described state. That is, FIG. 5(D) shows a normal state in which imbalance is present and in which the forcible introduction of imbalance has been carried out.

The amount of air is equivalent to 13 for only the #1 cylinder and 15 for the other cylinders as is the case with the state before the forcible introduction of imbalance. The fuel amount is 1.15 for only the #1 cylinder and 0.95 for the other cylinders as a result of the forcible introduction of imbalance and the stoichiometric control. Hence, the air-fuel ratio is 11.30 for only the #1 cylinder and 15.79 for the other cylinders. The imbalance rate is 15.79/11.30=1.3967=39.67%.

It should be noted that the imbalance rate obtained after the forcible introduction of imbalance (39.67%) is not equal to a value (36.43%) obtained by adding the amount of forced imbalance (21.03%) to the imbalance rate obtained before the forcible introduction of imbalance (15.38%). The actual imbalance rate obtained after the forcible introduction of imbalance (39.67%) is higher than the addition value (36.43%) by an error of 3.29%.

Figure 6:
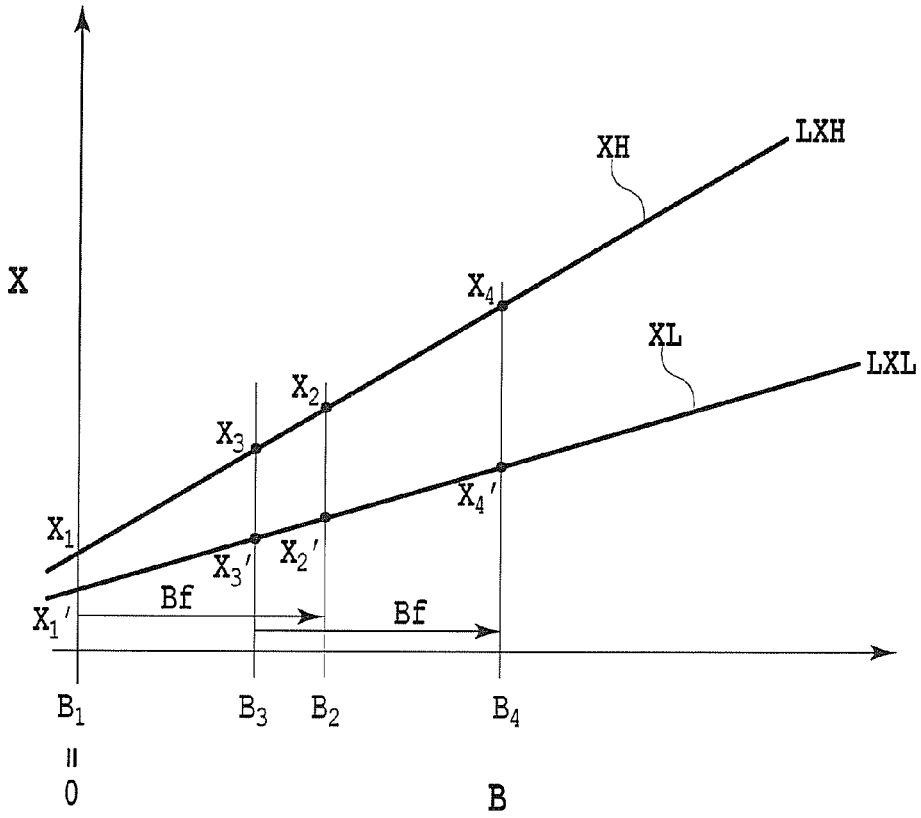
FIG. 6 is a graph showing the relation between an imbalance rate and an output fluctuation parameter.

As shown in FIG. 6, a linear and first-order proportional relation or characteristic (second characteristic) is present between the imbalance rate B and the output fluctuation parameter X. However, the relation varies according to the output characteristic of the pre-catalyst sensor 17 (hereinafter simply referred to as the sensor characteristic). In FIG. 6, LXH denotes the characteristic or characteristic line of a tolerance upper limit product of the pre-catalyst sensor 17. LXL denotes the characteristic or characteristic line of a tolerance lower limit product of the pre-catalyst sensor 17. As is well known, the tolerance upper limit product refers to a product that generates the highest output within a tolerance range in response to the same input. The tolerance lower limit product refers to a product that generates the lowest output within the tolerance range in response to the same input. The characteristic line LXH of the tolerance upper limit product has a larger inclination than the characteristic line LXL of the tolerance lower limit product.

For example, the characteristic line LXH of the tolerance upper limit product will be discussed. In the normal state in which no imbalance is present ($B=B_1$), imbalance of the forced imbalance amount Bf is forcibly introduced to set the imbalance rate to $B_2$. Then, the output fluctuation parameter X changes from $X_1$ to $X_2$, and the amount of change is $X_2-X_1$. On the other hand, in the normal state in which imbalance is present ($B=B_3$), imbalance of the forced imbalance amount Bf is forcibly introduced to set the imbalance rate to $B_4$. Then, the output fluctuation parameter X changes from $X_3$ to $X_4$, and the amount of change is $X_4-X_3$. The forced imbalance amount Bf and the inclination of the characteristic line LXH are constant, and thus both amounts of change are equal. Such a hypothetical state is referred to as an ideal state.

However, as is understood from a comparison with the above-described example, the actual state is different from the ideal state. This is because, even when imbalance apparently of the same amount or of the same amount in terms of control is introduced, the forced imbalance amount is actually not the same as the forced imbalance amount provided in the normal state in which no imbalance is present.

Likewise, the characteristic line LXL of the tolerance lower limit product will be discussed. In the normal state in which no imbalance is present ($B=B_1$), imbalance of the forced imbalance amount Bf is forcibly introduced to set the imbalance rate to $B_2$. Then, the output fluctuation parameter X changes from $X_1'$ to $X_2'$, and the amount of change is $X_2'-X_1'$. On the other hand, in the normal state in which imbalance is present ($B=B_3$), imbalance of the forced imbalance amount Bf is forcibly introduced to set the imbalance rate to $B_4$. Then, the output fluctuation parameter X changes from $X_3'$ to $X_4'$, and the amount of change is $X_4'-X_3'$. Both amounts of change are to be equal in the ideal state, but are actually not equal. That is, regardless of however the sensor output characteristic changes between a value for the tolerance upper limit product and a value for the tolerance lower limit product, the ideal state is actually not established.

Figure 7:
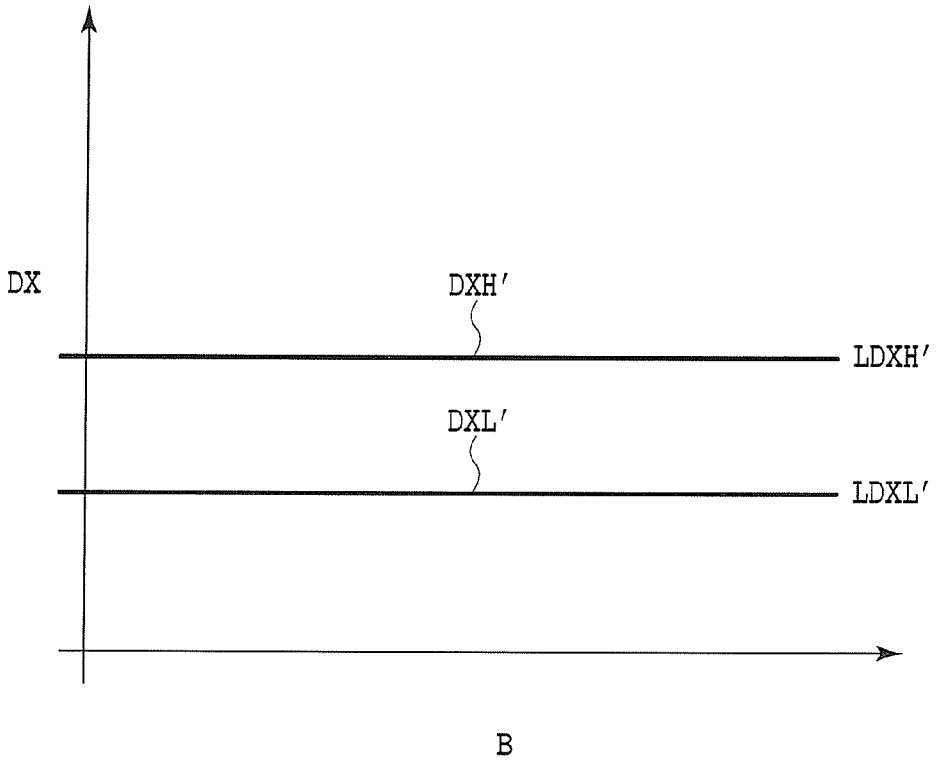
FIG. 7 is a graph showing a difference between the output fluctuation parameters obtained before and after forcible introduction of imbalance in an ideal state.

If the ideal state is successfully established, such a characteristic as shown in FIG. 7 is obtained. In this case, DX on the axis of ordinate represents the amount of change in output fluctuation parameter X resulting from the forcible introduction of imbalance, that is, the difference between the output fluctuation parameters X obtained before and after the forcible introduction of imbalance. $X_2-X_1$ and the like correspond to the difference DX. Furthermore, B on the axis of abscissas represents the imbalance rate obtained before the forcible introduction of imbalance, that is, the imbalance rate in the normal state.

As seen in FIG. 7, a characteristic or characteristic line LDXH' representing the relation between the imbalance rate B and the difference DXH' of the tolerance upper limit product is parallel to the axis of abscissas. The difference DXH' of the tolerance upper limit product is constant regardless of the imbalance rate B. Likewise, a characteristic or characteristic line LDXL' representing the relation between the imbalance rate B and the difference DXL' of the tolerance lower limit product is parallel to the axis of abscissas. The difference DXL' of the tolerance lower limit product is constant regardless of the imbalance rate B. However, the difference DXH' of the tolerance upper limit product is greater than the difference DXL' of the tolerance lower limit product.

However, such a characteristic as shown in FIG. 7 is actually not obtained.

On the other hand, the present inventors have found the following in the results shown in FIG. 5. That is, the imbalance rate (1.3967) obtained after the forcible introduction of imbalance shown in FIG. 5(D) is equal to the imbalance rate (1.1538) before the forcible introduction of imbalance shown in FIG. 5(C) multiplied by the forced imbalance amount (1.2105) (1.1538×1.2105=1.3967).

Figure 8:
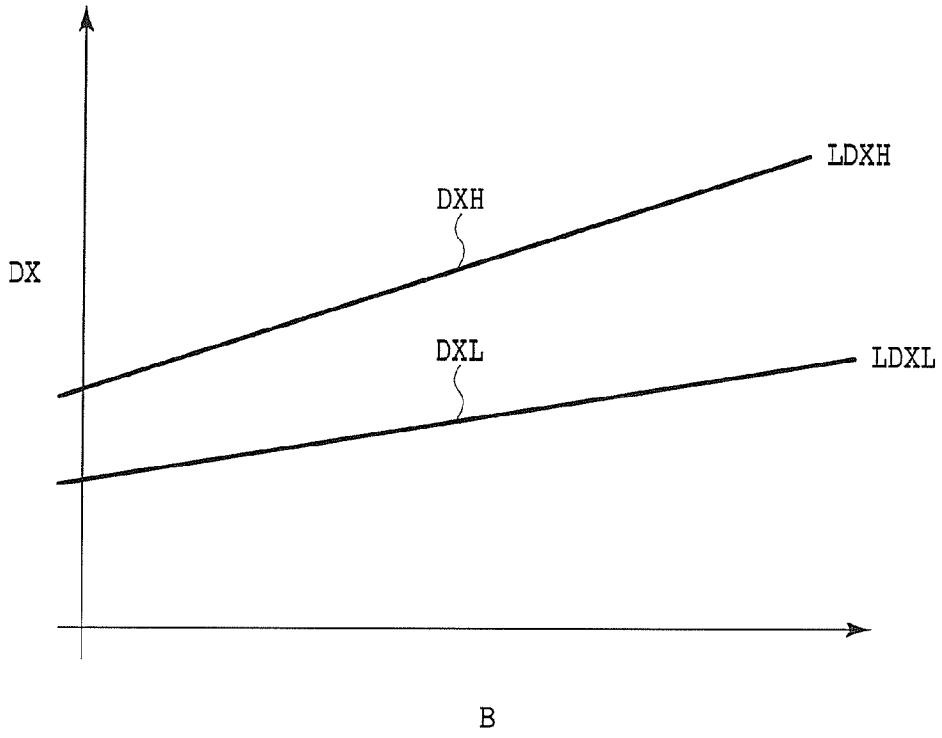
FIG. 8 is a graph showing a difference between the output fluctuation parameters obtained before and after the actual forcible introduction of imbalance.

As a result, instead of such a characteristic as shown in FIG. 7, such a characteristic as shown in FIG. 8 (first characteristic) is obtained. As seen in FIG. 8, the characteristic or the characteristic line LDXH representing the relation between the imbalance rate B and the difference DXH of the tolerance upper limit product is linear and first order proportional. The difference DXH increases consistently with the imbalance rate B. Likewise, the characteristic or the characteristic line LDXL representing the relation between the imbalance rate B and the difference DXL of the tolerance upper limit product is linear and first order proportional. The difference DXL increases consistently with the imbalance rate B. However, the characteristic line LDXH of the tolerance upper limit product has a larger inclination than the characteristic line LDXL of the tolerance lower limit product. The inclination of the characteristic line LDX varies according to the sensor output characteristic. The inclination increases with progression of the sensor output characteristic toward the tolerance upper limit product side.

Thus, the present embodiment particularly utilizes such a characteristic as shown in FIG. 8. The characteristic utilizes the output fluctuation parameter X obtained before the forcible introduction of imbalance, that is, the pre-catalyst sensor output. Consequently, the characteristic takes into account the degree of an actual variation in air-fuel ratio obtained before the forcible introduction of imbalance. The present embodiment can thus increase the accuracy of variation abnormality detection.

The technique in the above-described PTL1 fails to take into account the degree of a variation in air-fuel ratio before a forcible change in the amount of injected fuel. In other words, it is assumed that the air-fuel ratio is prevented from varying before a forcible change in the amount of injected fuel. Thus, if, in contrast to this assumption, the air-fuel ratio varies before the forcible change in the amount of injected fuel, whether or not the air-fuel ratio sensor has the appropriate output characteristic may fail to be accurately determined. Then, variation abnormality detection may be carried out in spite of the inappropriate output characteristic of the air-fuel ratio sensor, leading to misdetection. However, the present invention can eliminate these disadvantages.

The variation abnormality detection according to the present embodiment will be described below. The detection is mostly performed by the ECU 20 by carrying out steps described below.

(A) A step of calculating an output fluctuation parameter X1. In this step, the value X1 of the output fluctuation parameter obtained before the forcible introduction of imbalance, that is, the output fluctuation parameter in the normal state, is calculated or detected.

Figure 9:
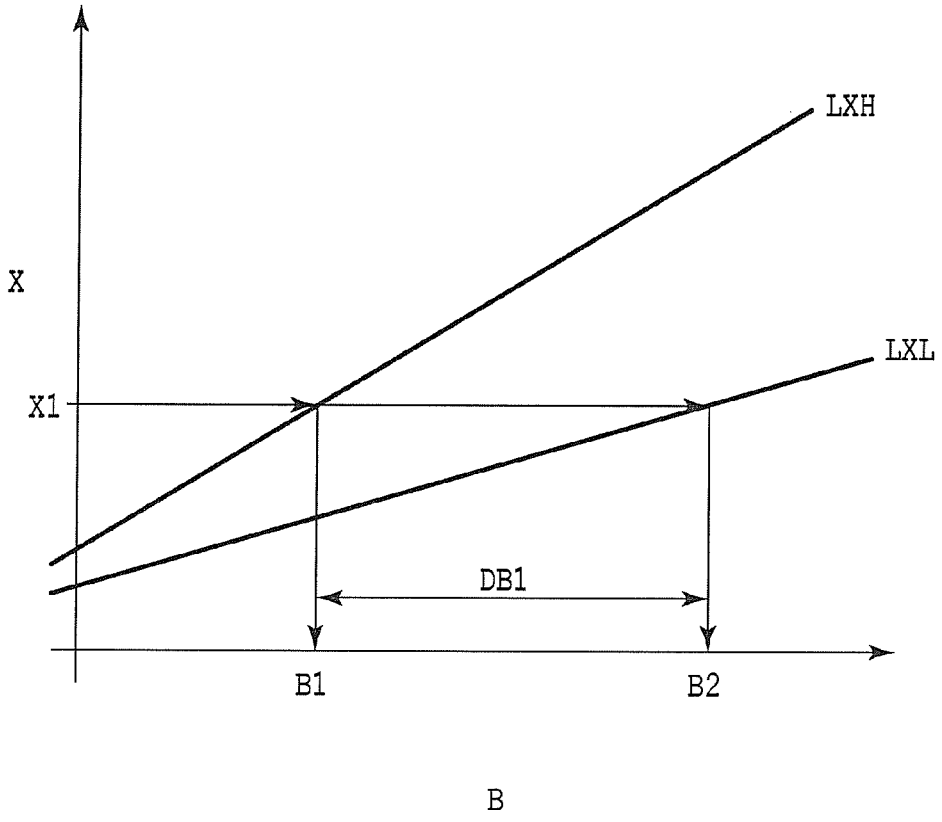
FIG. 9 is a graph illustrating a method for determining a possible range of the imbalance rate.

(B) A step of determining the possible range DB1 of the imbalance rate based on the calculated output fluctuation parameter X1. This step utilizes the relation between the imbalance rate B and the output fluctuation parameter X as shown in FIG. 6. That is, as shown in FIG. 9, first, the characteristics or characteristic lines LXH and LXL, representing the relation between the imbalance rate B and the output fluctuation parameter X, are predetermined for the tolerance upper limit product and the tolerance lower limit product, respectively, of the pre-catalyst sensor 17. The characteristics or characteristic lines LXH and LXL are determined by adaptation through actual machine tests or the like using an actual tolerance upper limit product and an actual tolerance lower limit product. The determined characteristics are prestored in the ECU 20.

Then, the process determines the intersection points between the output fluctuation parameter X1 actually calculated in step (A) and each of the characteristic lines LDX and LXL of the tolerance upper limit product and the tolerance lower limit product. As shown in FIG. 9, the two intersection points have coordinates (B1, X1) and (B2, X1), respectively. The range of the imbalance rate between the intersection points B1≤B≤B2 is determined to be the possible range DB1 of the imbalance rate. That is, the range of the imbalance rate B is limited based on the actually calculated output fluctuation parameter X1.

The present embodiment assumes that the actually installed pre-catalyst sensor 17 is normal and has an output characteristic between the output characteristic of the tolerance upper limit product and the output characteristic of the tolerance lower limit product. Thus, when the output fluctuation parameter X1 is actually obtained, the corresponding imbalance rate B is to have a value within the range of $B_1 \leq B \leq B_2$. Hence, this range is determined to be the possible range DB1.

The possible range DB1 depends on the degree of an actual variation in air-fuel ratio in the normal state and decreases and increases consistently with the degree of an actual variation in air-fuel ratio. In any case, the range DB1 represents the range of a variation in the output characteristic of the actually installed pre-catalyst sensor 17.

(C) A step of forcibly introduce imbalance by forcibly changing the air-fuel ratio of one predetermined cylinder and calculating an output fluctuation parameter X2.

In this step, the forcible introduction of imbalance is carried out, and the value X2 of the output fluctuation parameter is determined after the forcible introduction of imbalance. The phrase "after the forcible introduction of imbalance" means that the forcible introduction of imbalance is being carried out. While the forcible introduction of imbalance is being carried out, the amount of injected fuel injected by one predetermined cylinder (hereinafter referred to as a forcibly imbalanced cylinder) is forcibly or actively increased by a predetermined forced imbalance amount Bf. The forced imbalance amount Bf is equivalent to, for example, 1.1=10%.

In this case, the forcibly imbalanced cylinder is a cylinder in which rich shift imbalance is or is likely to be occurring in the normal state. That is, the forcible introduction of imbalance is such control as emphasizes the air-fuel ratio shift state of the cylinder in which an air-fuel ratio shift is or is likely to be occurring in the normal state. Hence, the present embodiment has a function to select or determine such a cylinder to be the forcibly imbalanced cylinder.

As shown in FIG. 4, during each engine cycle, ignition and combustion occur in the #1, #3, #4, and #2 cylinders in this order. The pre-catalyst sensor output A/F changes according to the exhaust air-fuel ratio of each cylinder. In FIG. 4, TDC means a compression top dead center. An illustrated example shows that rich shift imbalance is occurring in the #4 cylinder in the normal state. As shown in FIG. 4, when the pre-catalyst sensor 17 receives exhaust gas from the #4 cylinder, the pre-catalyst sensor output A/F decreases relatively rapidly toward the rich side. Otherwise the pre-catalyst sensor output A/F increases relatively slowly toward a lean side.

Hence, the present embodiment associates the pre-catalyst sensor output A/F with an output difference $\Delta A/F_n$, determines the average value of the output difference $\Delta A/F_n$ for each cylinder, and determines a cylinder with the largest average value on the negative side to be the forcibly imbalanced cylinder.

Alternatively or additionally, the forcible introduction of imbalance may be carried out by determining a cylinder in which lean shift imbalance is or is likely to be occurring to be the forcibly imbalanced cylinder and forcibly reducing the amount of fuel injected by the forcibly imbalanced cylinder by a predetermined amount. A well-known method or any other appropriate method may be used to identify the forcibly imbalanced cylinder.

(D) A step of calculating the difference DX1 between the output fluctuation parameters obtained before and after the forcible introduction of imbalance. This step calculates the difference DX1=X2−X1 between the value X1 of the output fluctuation parameter calculated in step (A) and the value X2 of the output fluctuation parameter calculated in step (C).

Figure 10:
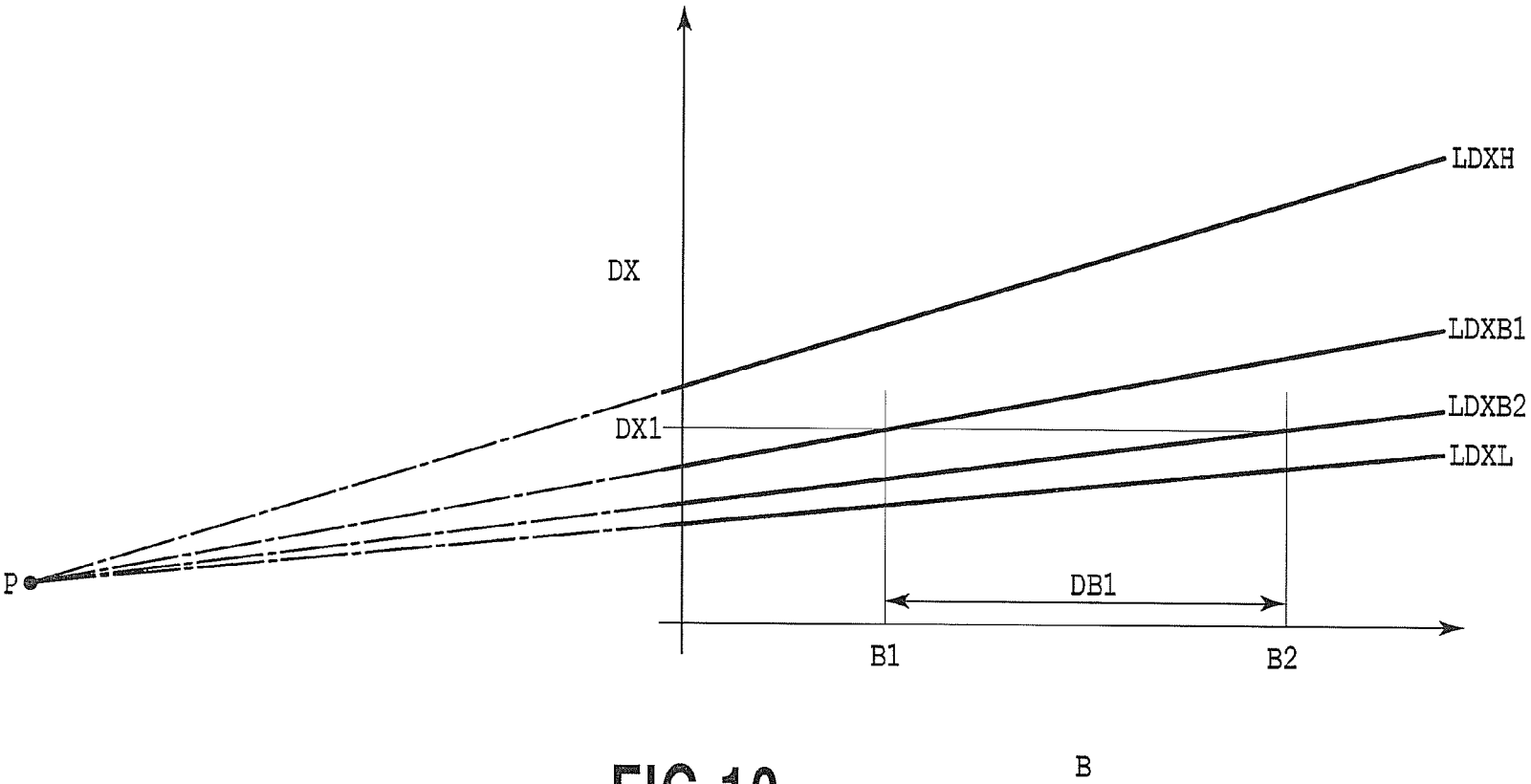
FIG. 10 is a graph illustrating a method for determining a characteristic representing the relation between the imbalance rate and a before-and-after difference.

(E) A step of determining a characteristic representing the relation between the possible range DB1 of the imbalance rate B and the difference DX1 based on the possible range of the imbalance rate and the difference DX1. This step utilizes the relation between such an imbalance rate B as shown in FIG. 8 and the difference between the output fluctuation parameters obtained before and after the forcible introduction of imbalance (which difference is hereinafter referred to as the before-and-after difference). That is, as shown in FIG. 10, first, the characteristics or characteristic lines LDXH and LDXL, representing the relation between the imbalance rate B and the before-and-after difference DX, are predetermined for the tolerance upper limit product and the tolerance lower limit product, respectively, of the pre-catalyst sensor 17. The characteristics or characteristic lines LXH and LXL are determined by adaptation through actual machine tests or the like using an actual tolerance upper limit product and an actual tolerance lower limit product. The determined characteristics are prestored in the ECU 20. The forcible introduction of imbalance may not actually be carried out in the adaptation stage, and the value of the output fluctuation parameter resulting from the forcible introduction of imbalance and thus characteristic lines LDXH and LDXL may be arithmetically determined. This method will be described below.

Then, based on the before-and-after difference DX1 actually calculated in step (D) and the possible range DB1 of the imbalance rate B determined in step (B), a characteristic or characteristic line to be determined in the present step is determined. Specifically, the characteristic lines LDXH and LDXL of the tolerance upper limit product and the tolerance lower limit product are interpolated to determine a characteristic or characteristic line passing through the intersection point between a predetermined value within the possible range of DB1 of the imbalance rate B and the actually calculated before-and-after difference DX1. The resulting characteristic or characteristic line is determined to be a characteristic or characteristic line to be determined in the present step.

According to the present embodiment, the predetermined value within the possible range DB1 of the imbalance rate B is such a value within the possible range as minimizes the degree of a variation in air-fuel ratio, that is, the minimum imbalance rate B1. Then, the characteristic lines LDXH and LDXL of the tolerance upper limit product and the tolerance lower limit product are interpolated to determine a characteristic or characteristic line LDXB1 passing through the intersection point between the imbalance rate B1 and the before-and-after difference DX1.

As shown in FIG. 10, the coordinates of the intersection point are (B1, DX1). Furthermore, a virtual intersection point between the characteristic lines LDXH and LDXL of the tolerance upper limit product and the tolerance lower limit product is denoted by P. A straight line passing through the virtual intersection point P and the intersection point (B1, DX1) is arithmetically determined. The resulting straight line is determined to be the characteristic line LDXB1. The characteristic line LDXB1 corresponds to the output characteristic of the actually installed pre-catalyst sensor 17.

For reference, FIG. 10 also shows a characteristic or characteristic line LDXB2 obtained when the predetermined value within the possible range DB1 of the imbalance rate B is such a value as minimizes the degree of a variation in air-fuel ratio, that is, the maximum imbalance rate B2. The characteristic or characteristic line to be determined in the present step may be any characteristic or characteristic line passing through the virtual intersection point P and located between the characteristic line LDXB1 and the characteristic line LDXB2. However, the predetermined value is preferably the minimum imbalance rate B. The reason will be explained below.

Figure 11:
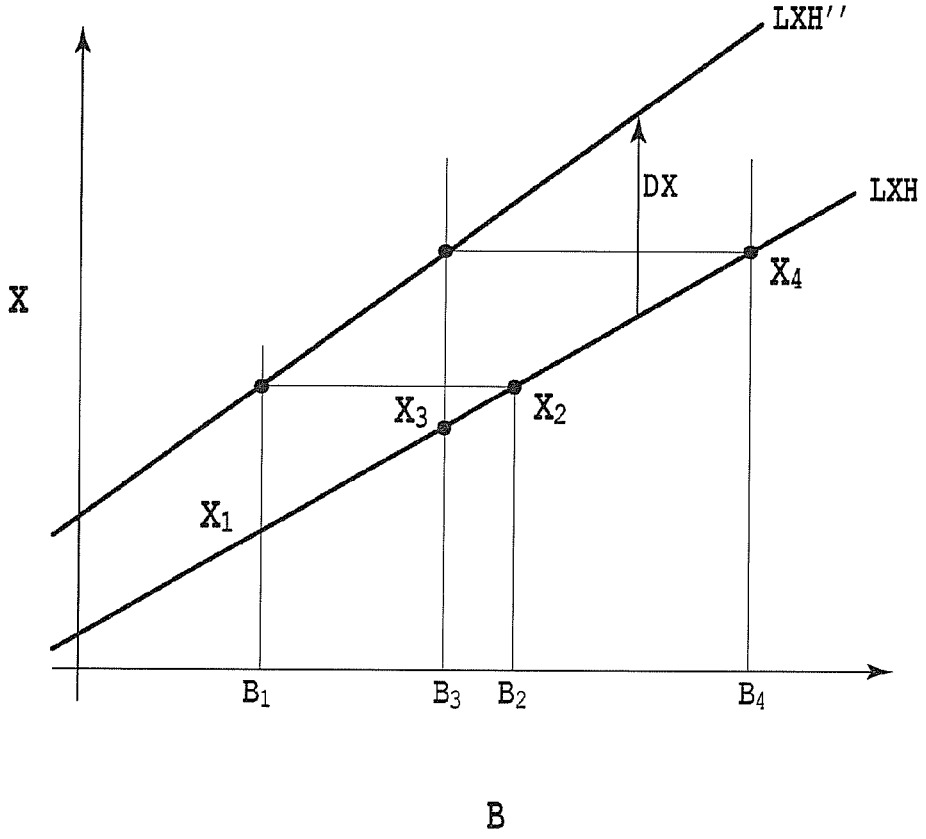
FIG. 11 is a graph illustrating a method for arithmetically determining the value of the output fluctuation parameter obtained after the forcible introduction of imbalance and thus a corresponding characteristic line.

Now, a method will be described which does not actually carry out the forcible introduction of imbalance during adaptation but which arithmetically determines the value of the output fluctuation parameter resulting from the forcible introduction of imbalance and thus the characteristic lines LDXH and LDXL. In this case, such known characteristic lines LXH and LXL as shown in FIG. 9 are utilized. For example, a point (B1, X1) on the characteristic line LXH of the tolerance upper limit product obtained before the forcible introduction of imbalance is noted as shown in FIG. 11. In this state, imbalance is forcibly introduced. Then, the imbalance rate $B_2$ resulting from the forcible introduction of imbalance is determined by $B_2=B_1\times Bf$. This determines the value $X_2$ of the output fluctuation parameter on the characteristic line LXH corresponding to $B_2$. The $X_2$ of the output fluctuation parameter is associated with the imbalance rate $B_1$ obtained before the forcible introduction of imbalance. Hence, a point $(B_1, X_2)$ represents the value $X_2$ of the output fluctuation parameter resulting from the forcible introduction of imbalance, which corresponds to the imbalance rate $B_1$ obtained before the forcible introduction of imbalance.

A similar operation is performed on another point $(B_3, X_3)$ before the forcible introduction of imbalance. Then, another point $(B_3, X_4)$ is determined which represents the value $X_4$ of the output fluctuation parameter resulting from the forcible introduction of imbalance, which corresponds to the imbalance rate $B_3$ obtained before the forcible introduction of imbalance. Then, a straight line passing through the point $(B_1, X_2)$ and the point $(B_3, X_4)$ is determined. The straight line is a characteristic line LXH" representing the relation between the imbalance rate B and the output fluctuation parameter X resulting from the forcible introduction of imbalance.

The before-and-after difference DX, obtained by reducing the value on the characteristic line LXH from the value on the characteristic line LXH", is determined for each imbalance rate B. Then, such a characteristic line LDXH as shown in FIG. 8 and FIG. 10 can be determined.

A similar operation is performed on the characteristic line LXL of the tolerance lower limit product. Then, a characteristic line LXL" (not shown in the drawings) can be determined which represents the relation between the imbalance rate B and the output fluctuation parameter X resulting from the forcible introduction of imbalance. The characteristic line LDXL can then be determined which represents the relation between the imbalance rate B and the before-and-after difference DX.

(F) A step of correcting one of the determination value α and the output fluctuation parameter X based on the inclination of the determined characteristic LDXB1. First, a method for correcting the determination value α will be described. The determination value α is a threshold compared with the output fluctuation parameter X actually calculated in order to determine whether or not variation abnormality is present.

First, the inclination S (LDXB1) of the characteristic line LDXB1 is calculated or acquired. The inclination as used herein refers to the ratio of the amount of change in the before-and-after difference DX to the amount of change in the imbalance rate X on the characteristic line as shown in FIG. 10.

Figure 12:
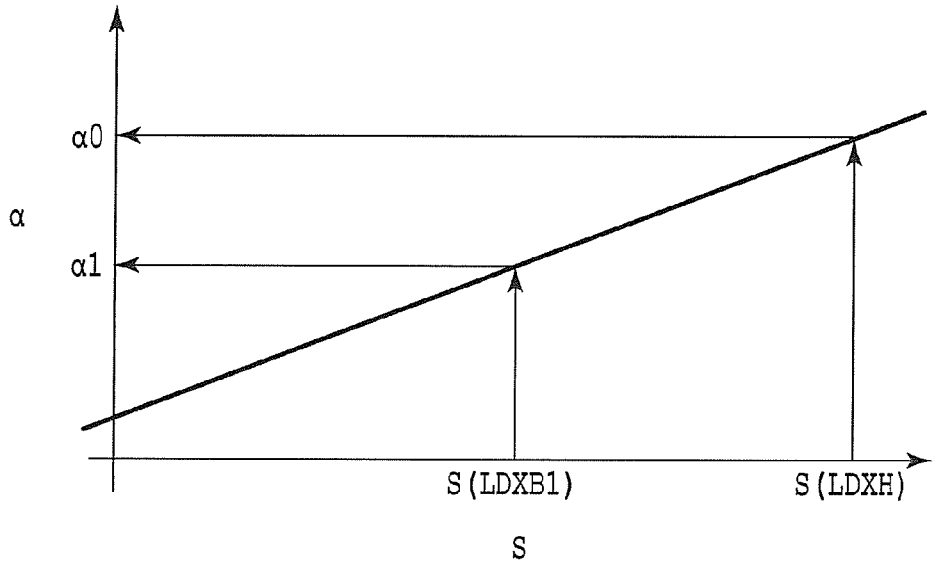
FIG. 12 is a diagram showing a correction map for correcting a determination value.

In accordance with such a correction map as shown in FIG. 12, a determination value α1 corresponding to the inclination S (LDXB1) is determined. As a consequence, a reference determination value α0 is corrected. The reference determination value α0 is a preset threshold for the actually installed pre-catalyst sensor 17, which corresponds to the tolerance upper limit product. Hence, the reference determination value α0 corresponds to the inclination S (LDXH) of the characteristic line LDXH of the tolerance upper limit product.

As seen in FIG. 12, the determination value α decreases with respect to the reference determination value α0 as the inclination S of the characteristic line LDX decreases with respect to the inclination S (LDXH) of the tolerance upper limit product. Thus, the determination value α is corrected to the smaller value α1, which reflects the actual sensor output characteristic, with respect to the preset reference determination value α0, which is intended for the tolerance upper limit product.

Figure 13:
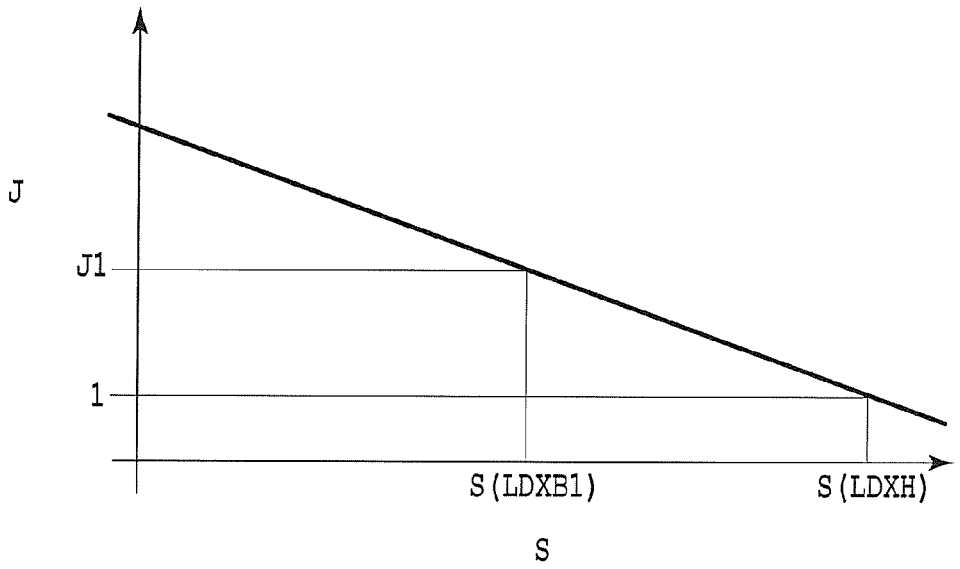
FIG. 13 is a diagram showing a correction map for correcting the output fluctuation parameter.

Now, a method for correcting the output fluctuation parameter will be described. Such a correction map as shown in FIG. 13 is used for the correction. The correction map allows determination of a correction coefficient J1 corresponding to the inclination S (LDXB1). The output fluctuation parameter X is corrected by multiplying the output fluctuation parameter X by the correction coefficient J1. A reference value for the correction coefficient J is a preset value of 1 for the pre-catalyst sensor 17, which corresponds to the tolerance upper limit product. Thus, the correction coefficient J=1 corresponds to the inclination S (LDXH) of the characteristic line LDXH of the tolerance upper limit product.

As seen in FIG. 13, the correction coefficient J increases from the reference value=1 as the inclination S of the characteristic line LDX decreases from the inclination S (LDXH) of the tolerance upper limit product. Hence, the output fluctuation parameter X is corrected to a larger value reflecting the actual sensor output characteristic.

Similarly, when the determination value α is corrected, the correction coefficient is determined, and the reference determination value α0 may be multiplied by the correction coefficient. Other methods for correction are possible.

(G) A step of comparing the corrected determination value α (or the output fluctuation parameter X) with the uncorrected output fluctuation parameter X (or the determination value α) to determine whether or not variation abnormality is present. This step is as described above. The determination value α (or the output fluctuation parameter X) is corrected according to the actual sensor output characteristic, thus allowing the variation abnormality detection to be accurately carried out.

The variation abnormality detection according to the present embodiment has been described in brief. The effects of the present embodiment will be additionally described.

As described above, in step (B), the possible range DB1 of the imbalance rate is determined (see FIG. 9). In step (E), the characteristic line LDXB1 corresponding to the before-and-after difference DX1 is determined based on the range DB1 (see FIG. 10). Then, in step (F), the corrected determination value α1 is determined based on the inclination S (LDXB1) of the characteristic line (see FIG. 12).

According to the present embodiment, when the characteristic line LDXB1 is determined, a straight line is determined to be the characteristic line LDXB1, the straight line passing through the intersection point between the minimum imbalance rate B1 within the range DB1 and the before-and-after difference DX1. That is, a predetermined value within the range DB1 is determined to be the minimum imbalance rate B1.

The reason why the above-described process is preferable is as follows. The minimum imbalance rate B1 is a value corresponding to the characteristic line LXH of the tolerance upper limit product as shown in FIG. 9. The tolerance upper limit product maximizes the value of the output fluctuation parameter X with respect to the same imbalance rate, that is, shifts the value toward a variation abnormality side. It is appropriate to determine the determination value α in association with the tolerance upper limit product as described above. This is because determining the determination value α in association with the tolerance lower limit product causes the corrected determination value α to be determined based on the smaller inclination of the characteristic line LDXB2 in FIG. 10, reducing the corrected determination value α. At this time, if the tolerance upper limit product is actually mounted, the apparatus may erroneously determine that variation abnormality is present though no variation abnormality is originally present. Such erroneous determination can be effectively suppressed by determining the characteristic line LDXB1 based on the minimum imbalance rate B1.

As shown in FIG. 10, when the characteristic line LDXB1 with the maximum inclination and the characteristic line LDXB2 with the minimum inclination are determined based on the actual before-and-after difference DX1, the possible range of the imbalance rate can further be substantially limited.

Figure 14:
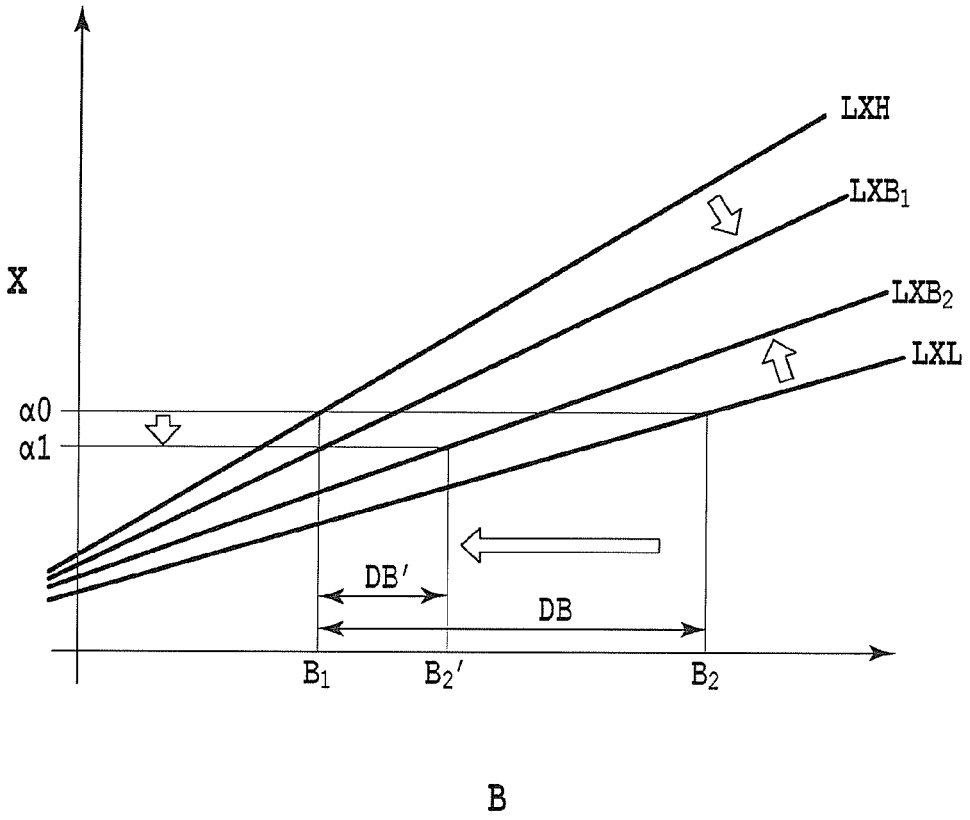
FIG. 14 is a graph illustrating the effects of the present embodiment.

As shown in FIG. 14, in the adaptation stage, a range of imbalance rate X is present for which variation abnormality is not to be determined to be present regardless of the type of the pre-catalyst sensor between the tolerance upper limit product and the tolerance lower limit product. According to the present embodiment, the range is, for example, less than 20%. In this view, $B_1$ is set to 20%, and the value of the output fluctuation parameter X corresponding to $B_1$ on the characteristic line LXH of the tolerance upper limit product is determined to be the reference determination value α0. In this case, when the actually mounted pre-catalyst sensor shifts toward the tolerance lower limit product side, the presence of variation abnormality fails to be determined until the imbalance rate reaches $B_2$. According to the present embodiment, $B_2$ is, for example, 50%. Finally, within the range of $B<B_1$, normality can be accurately determined independently of the sensor output characteristic. Within the range of $B>B_2$, abnormality can be accurately determined independently of the sensor output characteristic. The range of $B_1 \leq B \leq B_2$ is the range within which normality or abnormality is determined depending on the sensor output characteristic, that is, a gray zone.

On the other hand, characteristic lines $LXB_1$ and $LXB_2$ sandwiched between the characteristic lines LXH and LXL of the tolerance upper and lower limit products represent the relation between the imbalance rate X and the output fluctuation parameter X which corresponds to both characteristic lines LDXB1 and LDXB2 based on the actual before-and-after difference DX1. The corrected determination value α1 is determined based on $LXB_1$. DB' denotes the range of the imbalance rate between the intersection points between the corrected determination value α1 and each of the characteristic lines $LXB_1$ and $LXB_2$.

The range DB' is $B_1 \leq B \leq B_2'$. The minimum value is $B_1$ and is equal to the minimum value of the range DB. However, the maximum value is $B_2'$ smaller than $B_2$, obtained during adaptation. According to the present embodiment, $B_2'$ is, for example, 30%. Thus, the range DB' is narrower than the range DB defined in the adaptation stage. The range DB' is the possible range of imbalance rate X corresponding to the actually mounted pre-catalyst sensor. Hence, the possible range of the imbalance rate X is more limited than during adaptation.

In this case, the range within which normality can be accurately determined regardless of the sensor output characteristic is $B<B_1$, which is the same range as that obtained during adaptation. However, the minimum value of the range within which abnormality can be accurately determined regardless of the sensor output characteristic is $B_2'$, which is smaller than $B_2$. This allows abnormality to be accurately determined based on a lower imbalance rate X. The range within which normality or abnormality is determined depending on the sensor output characteristic, that is, the gray zone, is limited to a narrower range $B_1 \leq B \leq B_2'$. This enables a reduction in the range of the imbalance rate within which erroneous determination is likely to occur. Thus, the accuracy of the variation abnormality detection can be increased.

Now, a more specific process for the variation abnormality detection according to the present embodiment will be described.

Figure 15:
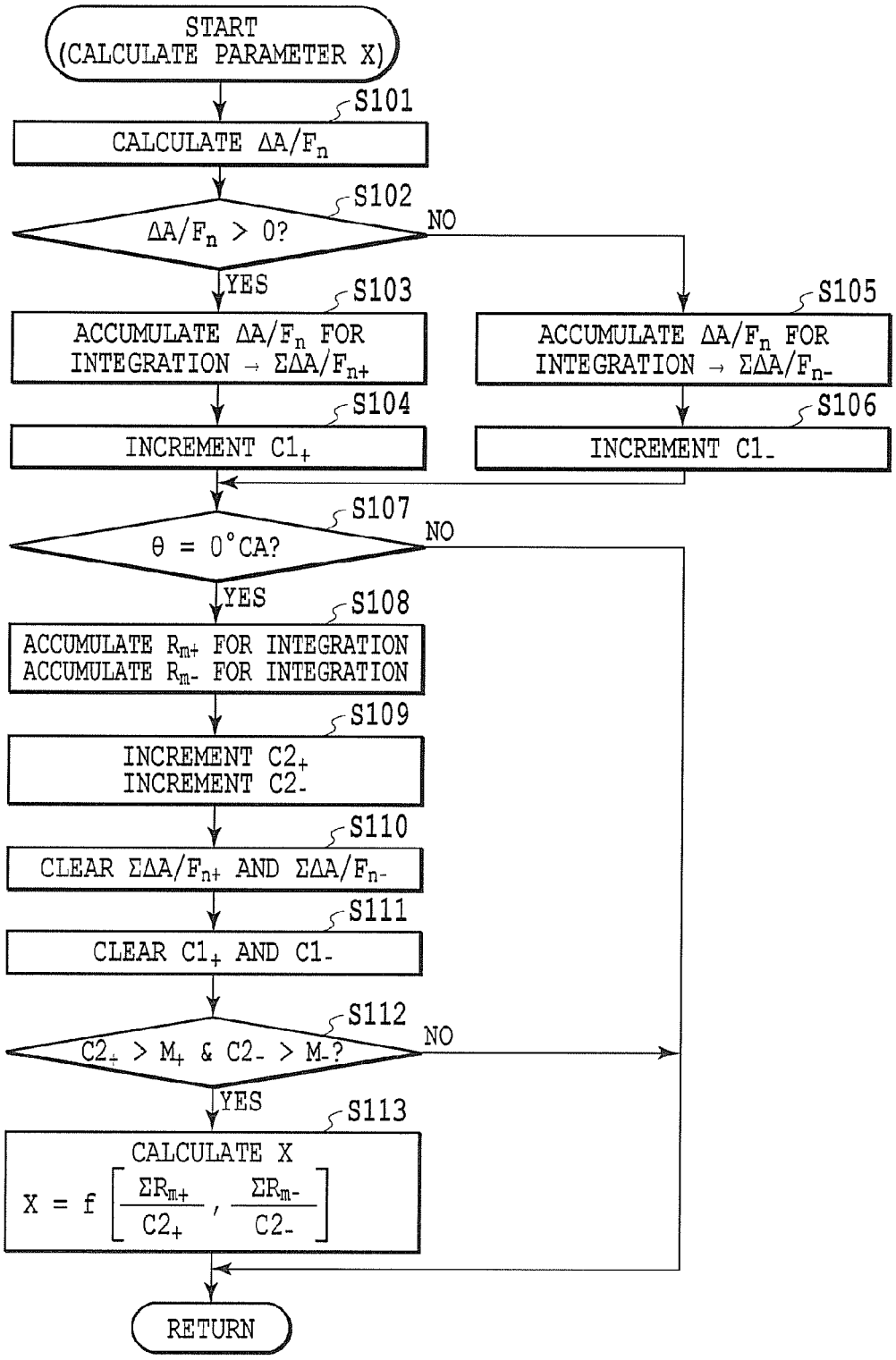
FIG. 15 is a flowchart of a process of calculating the output fluctuation parameter.

First, a process of calculating the output fluctuation parameter X, which is a basic process according to the present embodiment, will be described. The calculation process is carried out by the ECU 20 by repeatedly executing such a routine as shown in FIG. 15 during every operation period.

First, in step S101, a pre-catalyst sensor output $A/F_n$ at the current sample time or timing n is acquired. A sensor output difference $\Delta A/F_n$ at the current timing is calculated in accordance with Formula (2). Now, both values of the pre-catalyst sensor output $A/F_n$ and the sensor output difference $\Delta A/F_n$ are associated with the numbers of cylinders to which exhaust gas causing both values to be obtained is emitted. Both values and the cylinder numbers are stored in the ECU in sets. This is to allow the forcibly imbalanced cylinder to be subsequently identified.

Then, in step S102, whether the sensor output difference $\Delta A/F_n$ obtained at the current timing is greater than zero is determined. If the sensor output difference $\Delta A/F_n$ is greater than zero, that is, the sensor output difference (inclination) $\Delta A/F_n$ obtained at the current timing is positive and has a value obtained during an increase in pre-catalyst sensor output, step S103 accumulates, for integration, the positive sensor output characteristic $\Delta A/F_n$ obtained at the current timing. The integrated value $\Sigma\Delta A/F_{n+}$ is calculated by:

$$\Sigma\Delta A/F_{n+}=\Sigma\Delta A/F_{(n-1)+}+\Delta A/F_n \tag{3}$$

Then, in step S104, the number of integrations $C1_+$ of the positive sensor output difference (inclination) $\Delta A/F_n$ is incremented by 1.

On the other hand, in step S102, if the sensor output difference $\Delta A/F_n$ is equal to or smaller than zero, that is, the sensor output difference (inclination) $\Delta A/F_n$ obtained at the current timing is zero or negative and has a value obtained while the pre-catalyst sensor output remains unchanged or is decreasing, step S105 accumulates, for integration, the negative sensor output characteristic $\Delta A/F_n$ obtained at the current timing. The integrated value $\Sigma\Delta A/F_{n+}$ is calculated by:

$$\Sigma\Delta A/F_{n-}=\Sigma\Delta A/F_{(n-1)-}+\Delta A/F_n \quad (4)$$

Then, in step S106, the number of integrations C1_ of the negative sensor output difference (inclination) $\Delta A/F_n$ is incremented by 1.

Then, step S107 determines whether or not a crank angle θ obtained at the current timing is 0° CA that is a reference crank angle during each engine cycle (0 to 720° CA). The reference crank angle defines a timing for calculating the average value of the sensor output difference $\Delta A/F_n$ during each engine cycle. The reference crank angle can be set to a value other than 0° CA. According to the present embodiment, 0° CA, which is the reference crank angle, is equal to the compression top dead center of the #1 cylinder (see FIG. 4).

When the crank angle θ is not 0° CA, the routine is terminated. On the other hand, when the crank angle θ is 0° CA, step S108 calculates the average value of the sensor output difference $\Delta A/F_n$ at the end of one engine cycle and accumulates the average value for integration. First, for a positive sensor output difference $\Delta A/F_n$, the integrated value $\Sigma\Delta A/F_{n+}$ of the positive sensor output difference is divided by the number of integrations $C1_+$ to calculate an average value for each engine cycle $R_{m+}$ $(=\Sigma\Delta A/F_{n+})/C1_+)$. The average value $R_{m+}$ is added to the integrated value of the average value for each engine cycle to determine the integrated value $\Sigma R_{m+}$ of the average value $R_{m+}$. The integrated value $\Sigma R_{m+}$ is calculated by:

$$\Sigma R_{m+}=\Sigma R_{(m-1)+}+R_{m+} \quad (5)$$

Similarly, for a negative sensor output difference $\Delta A/F_n$, the integrated value $\Sigma\Delta A/F_{n-}$ of the negative sensor output difference is divided by the number of integrations C1_ to calculate an average value for each engine cycle $R_{m-}$ $(=\Sigma\Delta A/F_{n-})/C1_{-1})$. The average value $R_{m-}$ is added to the integrated value of the average value for each engine cycle to determine the integrated value $\Sigma R_{m-}$ of the average value $R_{m-}$. The integrated value $\Sigma R_{m-}$ is calculated by:

$$\Sigma R_{m-}=\Sigma R_{(m-1)-}+R_{m-} \quad (6)$$

Then, in step S109, the values of the numbers of integrations $C2_+$ and C2_ of the positive average value $R_{m+}$ and the negative average value $R_{m-}$ for each engine cycle are incremented by 1.

Subsequently, in step S110, the integrated value $\Sigma\Delta A/F_{n+}$ $AA/F_{n+}$ of the positive sensor output difference and the integrated value $\Sigma\Delta A/F_{n-}$ of the negative sensor output difference are cleared to zero.

Then, in step S111, the values of the number of integrations $C1_+$ of the positive sensor output difference and the number of integrations C1_ of the negative sensor output difference are cleared to zero.

Then, step S112 determines whether or not the number of integrations $C2_+$ of the positive average value for each engine cycle reaches a threshold $M_+$ and the number of integrations C2_ of the negative average value for each engine cycle reaches a threshold M_. According to the present embodiment, for example, $M_+=M_-=50$. If the result of the determination is negative, the routine is terminated.

On the other hand, if the result of the determination is affirmative, step S113 calculates the average value $(\Sigma R_{m+})/C2_+$ for $M_+$ engine cycles equal to the integrated value $\Sigma R_{m+}$ divided by the number of integrations $C2_+$ and the average value $(\Sigma R_{m-})/C2_-$ for M_ engine cycles equal to the integrated value $\sigma R_{m-}$ divided by the number of integrations C2_. The output fluctuation parameter X is then calculated based on both average values.

According to the present embodiment, the average value of the absolute value of both average values is calculated to be the output fluctuation parameter X. However, any other value may be used. For example, the larger of the absolute values of both average values or the sum of the absolute values of both average values may be calculated to be the output fluctuation parameter X. When the output fluctuation parameter X is calculated, the routine is terminated.

Now, a process of detecting variation abnormality will be described. The detection process is carried out by the ECU 20 in accordance with such an algorithm as illustrated in a flowchart in FIG. 16.

First, in step S201 determines whether or not a predetermined prerequisite suitable for execution of the variation abnormality detection has been achieved. For example, the prerequisite is achieved when the following conditions are met. However, other examples the conditions are possible. (1) Warm-up of the engine has ended. (2) The pre-catalyst sensor 17 and the post-catalyst sensor 18 have been activated. (3) The upstream catalyst 11 and the downstream catalyst 19 have been activated. (4) The engine is operating steadily. (5) The number of rotations Ne of the engine and a load KL fall within predetermined ranges. (6) Stoichiometric control is being performed.

If the prerequisite has not been achieved, the process waits. If the prerequisite is achieved, the process proceeds to step S202. In step S202, the value of the output fluctuation parameter X obtained before the forcible introduction of imbalance is calculated. The calculation is carried out by executing a routine illustrated in FIG. 15.

In step S203, the possible range DB of the imbalance rate is determined based on the calculated output fluctuation parameter X, as shown in FIG. 9.

In step S204, the forcibly imbalanced cylinder is identified. At this time, tuple data of the sensor output difference $\Delta A/F_n$ and the cylinder number acquired in step S101 of the routine in FIG. 15 is utilized.

For example, the average value of the sensor output difference $\Delta A/F_n$ (whether positive or negative) for each cylinder number is determined, and a cylinder with the largest absolute value of the average value is determined to be the forcibly imbalanced cylinder. As seen in FIG. 4, the average value of the sensor output difference $\Delta A/F_n$ for the #4 cylinder in which rich shift imbalance is occurring in the normal state is larger than the average vales of the sensor output difference $\Delta A/F_n$ for the other cylinders. Hence, this method enables the forcibly imbalanced cylinder to be identified.

In this case, the process determines whether the forcibly imbalanced cylinder is suffering (or is likely to suffer) rich shift imbalance or is suffering lean shift imbalance in the normal state. At this time, lean shift imbalance is determined to be occurring when the average value of the sensor output difference $\Delta A/F_n$ for the forcibly imbalanced cylinder is positive. Rich shift imbalance is determined to be occurring when the average value of the sensor output difference $\Delta A/F_n$ for the forcibly imbalanced cylinder is negative.

In step S205, imbalance is forcibly introduced. That is, the amount of fuel injected by the forcibly imbalanced cylinder is increased or reduced by a predetermined value. At this time, if, in step S204, the forcibly imbalanced cylinder is determined to be suffering rich shift imbalance, the amount of injected fuel is increased to emphasize the rich shift state. In contrast, if, in step S204, the forcibly imbalanced cylinder is determined to be suffering lean shift imbalance, the amount of injected fuel is reduced to emphasize the lean shift state.

Step S206 calculates the value of the output fluctuation parameter X obtained after the forcible introduction of imbalance. Again, the calculation is carried out by executing the routine shown in FIG. 15.

Step S207 calculates the difference between the output fluctuation parameters X obtained before and after the forcible introduction of imbalance, that is, the before-and-after difference DX. This calculation is carried out by subtracting the value of the output fluctuation parameter X calculated in step S202 from the value of the output fluctuation parameter X calculated in step S206.

Step S208 determines the characteristic line LDX (=LDXB1) representing the relation between the imbalance rate B and the before-and-after difference DX based on the calculated before-and-after difference DX and the possible range DB of the imbalance rate, as shown in FIG. 10.

In step S209, the inclination S (=S(LDXB1) of the characteristic line LDX (=LDXB1) is determined.

In step S210, the corrected determination value $\alpha$ (=$\alpha$1) is determined based on the determined inclination S (=S (LDXB1)) as shown in FIG. 12.

Step S211 compares the value of the output fluctuation parameter X obtained before the forcible introduction of imbalance, which has been calculated in step S202, with the corrected determination value $\alpha$, determined in step S210.

If the value of the output fluctuation parameter X is smaller than the value of the determination value $\alpha$, the absence of variation abnormality, that is, normality, is determined in step S212.

If the value of the output fluctuation parameter X is equal to or larger than the value of the determination value $\alpha$, step S213 determines that variation abnormality is present, that is, the engine is abnormal. At this time, a warning device such as a check lamp is actuated to inform the user of the abnormality to urge the user to repair the engine.

Now, a variation of the present embodiment will be described.

The actual state of engine operation before the forcible introduction of imbalance may differ from the actual state of engine operation after the forcible introduction of imbalance. Then, the accuracy of calculation of the before-and-after difference DX may decrease. This may in turn reduce the accuracy of the variation abnormality detection.

Thus, in order to suppress such a decrease in accuracy, the variation carries out normalization such that the values of the output fluctuation parameter X calculated before and after the forcible introduction of imbalance are each equal to a value obtained under given engine operation conditions.

Then, the operation conditions for the output fluctuation parameter X calculated before the forcible introduction of imbalance are substantially the same as the operation conditions for the output fluctuation parameter X calculated after the forcible introduction of imbalance. This increases the accuracy of calculation of the before-and-after difference DX and thus the accuracy of the variation abnormality detection.

Figure 17:
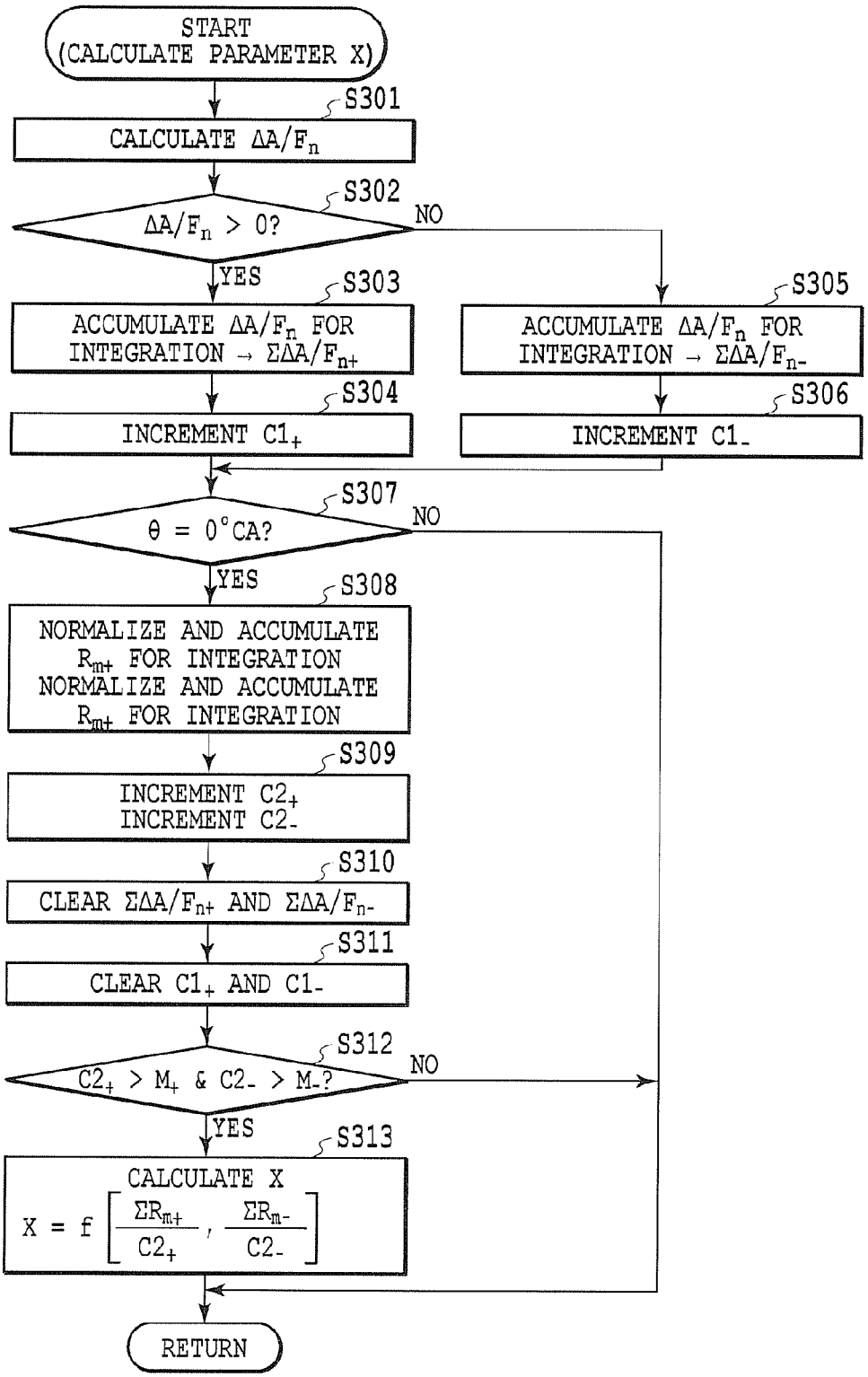
FIG. 17 is a flowchart of a process of calculating the output fluctuation parameter according to a variation.

FIG. 17 shows a flowchart of a process of calculating the output fluctuation parameter according to the variation. This calculation process is approximately the same as the calculation process shown in FIG. 15. Description of identical steps is thus omitted with the reference numerals of the steps changed to the 300s. The only difference between these calculation processes is that step S108 is replaced with step 308A where a normalization process is carried out.

In step S308A, the average values $R_{m+}$ and $R_{m-}$ for each engine cycle calculated for the current engine cycle are normalized according to an average engine operation state during the engine cycle, specifically, the average values of the detected number of engine rotations Ne and engine load KL. Then, the normalized average values $R_{m+}$ and $R_{m-}$ are accumulated for integration.

Figure 18:
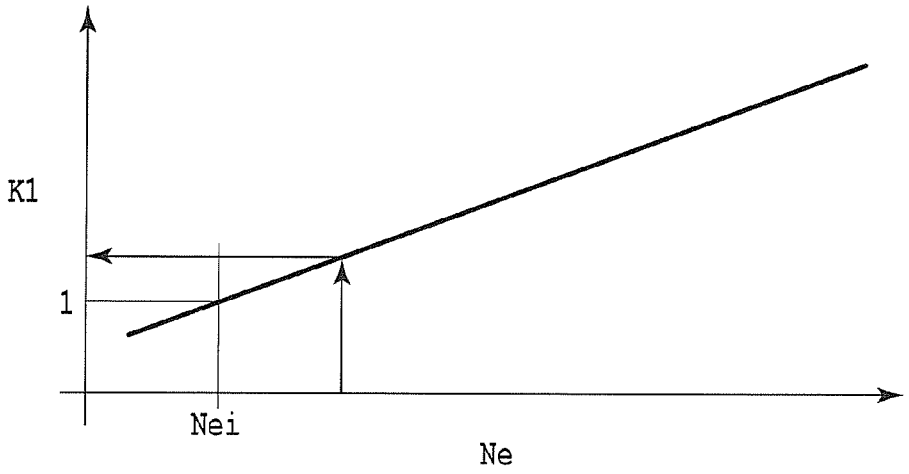
FIG. 18 is a diagram showing a number-of-rotation normalization map.
Figure 19:
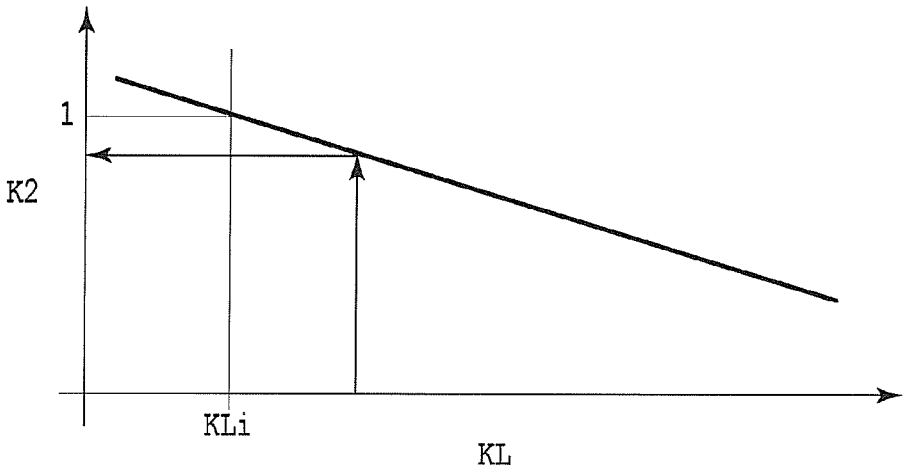
FIG. 19 is a diagram showing a load normalization map.

Such predetermined maps as shown in FIG. 18 and FIG. 19 are used for the normalization. In a number-of-rotations normalization map shown in FIG. 18, a coefficient of number-of-rotations normalization K1 is 1 when the number of engine rotations Ne is equal to the number of idle rotations Nei that is a predetermined normalizing number-of-rotations. The coefficient of number-of-rotations normalization K1 increases with the number of engine rotations Ne. The coefficient of number-of-rotations normalization K1 corresponding to the detected number of engine rotations Ne is determined from the map. The average values $R_{m+}$ and $R_{m-}$ are multiplied by the determined coefficient of number-of-rotations normalization K1. This allows normalization for the number of engine rotations to be performed.

In general, the sensor output difference $\Delta A/F$ tends to decrease with increasing number of engine rotations Ne. Thus, the normalization as described above allows the average values $R_{m+}$ and $R_{m-}$ detected at any number of rotations to be normalized to values obtained at the number of idle rotations Nei.

Similarly, in a load normalization map shown in FIG. 19, a coefficient of load normalization K2 is 1 when the engine load KL is equal to an idle load KLi that is a predetermined normalizing load. The coefficient of load normalization K2 decreases with increasing engine load KL. The coefficient of load normalization K2 corresponding to the detected engine load KL is determined from the map. The average values $R_{m+}$ and $R_{m-}$ are multiplied by the determined coefficient of load normalization K2. This allows normalization for the engine load to be performed.

In general, the sensor output difference $\Delta A/F$ tends to increase consistently with engine load KL. Thus, the normalization as described above allows the average values $R_{m+}$ and $R_{m-}$ detected under any load to be normalized to values obtained under the idle load KLi.

Finally, a normalized positive average value is calculated to be ($R_{m+}\times K1\times K2$), and a normalized negative average value is calculated to be ($R_{m-}\times K1\times K2$). These values are accumulated for integration. When the subsequent steps are carried out based on these integrated values, the normalized value of the output fluctuation parameter X can consequently be obtained.

Figure 16:
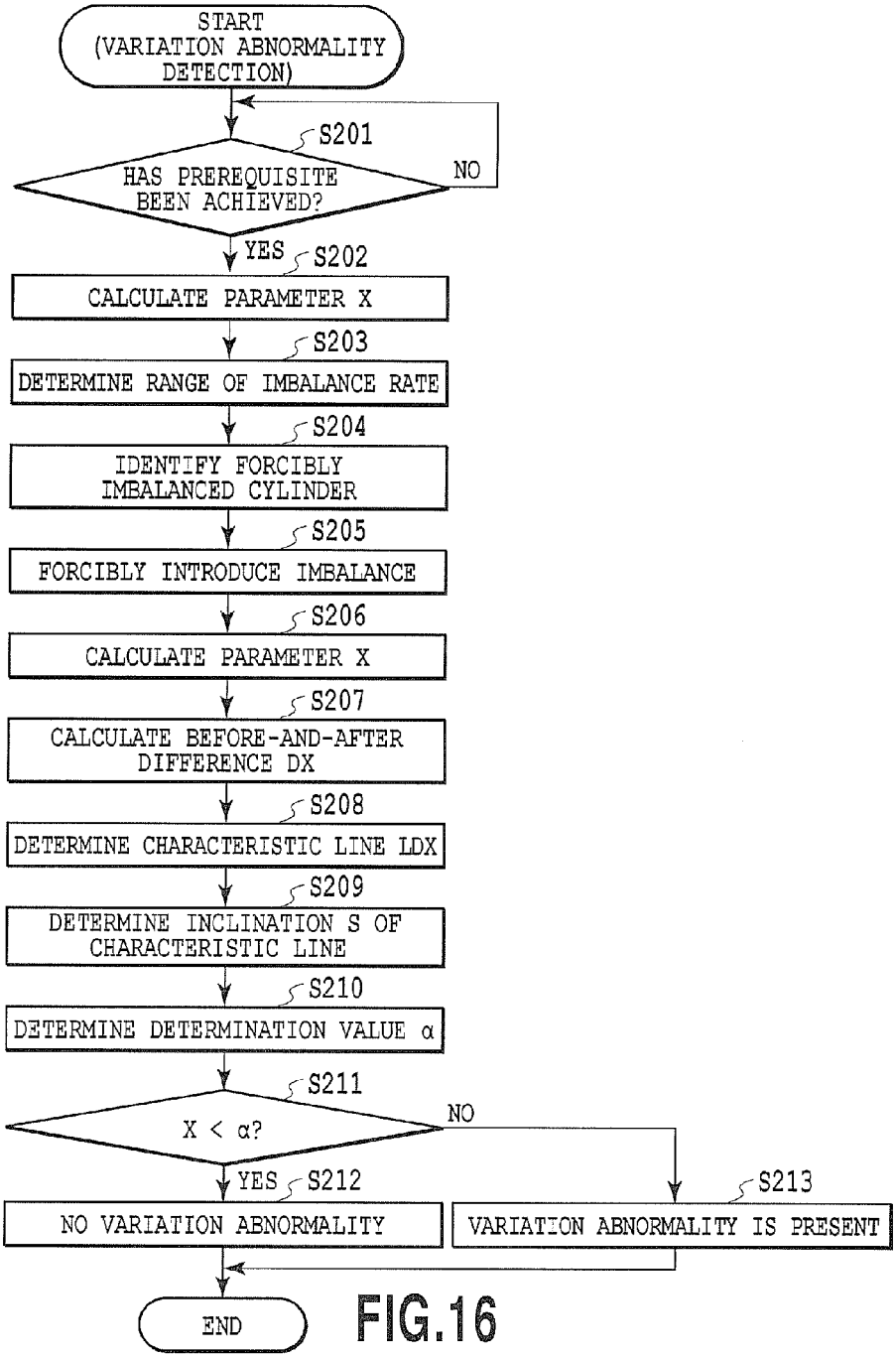
FIG. 16 is a flowchart of a process of detecting variation abnormality.

In steps S202 and S206 in FIG. 16, the normalized value of the output fluctuation parameter X is calculated. Thus, in step S207, the value of the before-and-after difference DX is also calculated under the given operation conditions, using the normalized value of the output fluctuation parameter X. This enables an increase in the accuracy of calculation of the before-and-after difference DX and thus in the accuracy of the variation abnormality detection.

The present embodiment carries out normalization by multiplication by the coefficients of normalization K1 and K2. However, the normalization may be performed by addition or the like. Furthermore, normalization may be carried out on the individual sensor output differences $\Delta A/F_n$ obtained in step S301, the value of the output fluctuation parameter X finally obtained in step S313, or the like.

The preferred embodiment of the present invention has been described in detail. However, various other embodiments of the present invention are possible. For example, the above-described numerical values are illustrative and may be variously changed. Furthermore, in some portions of the description, only one of the rich shift imbalance and the lean shift imbalance is described. However, those skilled in the art understand that the description of one of the imbalances is applicable to the description of the other.

The embodiment of the present invention is not limited to the above-described embodiment. The present invention includes any variations, applications, and equivalents embraced in the concepts of the present invention defined by the claims. Thus, the present invention should not be interpreted in a limited manner but is applicable to any other technique belonging to the scope of the concepts of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An inter-cylinder air-fuel ratio variation abnormality detection apparatus for a multicylinder internal combustion engine, the apparatus being configured to calculate a first parameter correlated with a degree of a variation in output from an air-fuel ratio sensor installed in an exhaust passage common to a plurality of cylinders and comparing the calculated first parameter with a predetermined determination value to detect variation abnormality in air-fuel ratio among cylinders, the apparatus being configured to carry out:

(A) a step of calculating the first parameter;

(B) a step of determining a possible range of a second parameter different from the first parameter, the second parameter representing a degree of a variation in air-fuel ratio among the cylinders based on the calculated first parameter, the second parameter being a value representing a rate at which a cylinder subjected to air-fuel ratio shift deviates from the cylinders free from the air-fuel ratio shift;

(C) a step of calculating the first parameter with an air-fuel ratio of a predetermined cylinder forcibly changed;

(D) a step of calculating a difference between the unchanged first parameter and the forcibly changed first parameter;

(E) a step of determining a first characteristic representing a relation between the second parameter and the difference based on the possible range of the second parameter and the difference; and (F) a step of correcting one of the determination value and the first parameter calculated in the step (A) based on inclination of the determined first characteristic, wherein, in the step (B), second characteristics which are preset for the tolerance upper limit product and the tolerance lower limit product of the air-fuel ratio sensor and which represent relations between the first parameter and the second parameter are utilized to determine the possible range of the second parameter.

2. The inter-cylinder air-fuel ratio variation abnormality detection apparatus according to claim 1, wherein, in the step (E), the first characteristics preset for a tolerance upper limit product and a tolerance lower limit product of the air-fuel ratio sensor are utilized to determine the first characteristic passing through an intersection point between the difference calculated in the step (D) and a predetermined value within the possible range of the second parameter by interpolating the first characteristics of the tolerance upper limit product and the tolerance lower limit product, and the resulting first characteristic is determined to be first characteristic to be determined.

3. The inter-cylinder air-fuel ratio variation abnormality detection apparatus according to claim 2, wherein the predetermined value within the possible range of the second parameter is such a value within the possible range of the second parameter as minimizes the degree of a variation.

4. The inter-cylinder air-fuel ratio variation abnormality detection apparatus according to claim 2, wherein the first characteristics preset for the tolerance upper limit product and the tolerance lower limit product of the air-fuel ratio sensor are such characteristics as increases the difference as the second parameter varies toward higher degrees of variation.

5. The inter-cylinder air-fuel ratio variation abnormality detection apparatus according to claim 2, wherein the inclination of the first characteristic preset for the tolerance upper limit product is larger than the inclination of the first characteristic preset for the tolerance lower limit product.

6. The inter-cylinder air-fuel ratio variation abnormality detection apparatus according to claim 1, wherein, in the step (B), the possible range of the second parameter is determined to be a range of the second parameter between intersection points between the first parameter calculated in the step (A) and each of the second characteristics of the tolerance upper limit product and the tolerance lower limit product.

7. The inter-cylinder air-fuel ratio variation abnormality detection apparatus according to claim 1, wherein the steps (A) and (C) include a step of normalizing the first parameter according to an operating status of the internal combustion engine.

* * * * *